US007110702B2

(12) United States Patent
Tomono et al.

(10) Patent No.: US 7,110,702 B2
(45) Date of Patent: Sep. 19, 2006

(54) DEVELOPING APPARATUS INCLUDING A PLURALITY OF TWO-CHAMBER DEVELOPER CONTAINERS WHEREIN A CEILING HEIGHT OF THE SECOND CHAMBER IS HIGHER NEAR A DISCHARGE OPENING

(75) Inventors: Toshiro Tomono, Ibaraki (JP); Masashige Tamura, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 240 days.

(21) Appl. No.: 10/832,380

(22) Filed: Apr. 27, 2004

(65) Prior Publication Data

US 2004/0265008 A1 Dec. 30, 2004

(30) Foreign Application Priority Data

May 2, 2003 (JP) ..... 2003-127120

(51) Int. Cl.
*G03G 15/01* (2006.01)
*G03G 15/08* (2006.01)

(52) U.S. Cl. ..... 399/227

(58) Field of Classification Search ..... 399/227, 399/223

See application file for complete search history.

(56) References Cited

U.S. PATENT DOCUMENTS 5,508,794 A 4/1996 Ikesue et al.
5,752,141 A * 5/1998 Nishimura et al. ..... 399/227
6,920,301 B1 * 7/2005 Arimoto ..... 399/227
6,934,491 B1 * 8/2005 Tamura ..... 399/227
2003/0202823 A1 10/2003 Tamura ..... 399/227

FOREIGN PATENT DOCUMENTS

| | | |
|---|---|---|
| JP | 6-308829 | 11/1994 |
| JP | 9-218575 | 8/1997 |
| JP | 10-142888 | 5/1998 |
| JP | 11-231640 | 8/1999 |
| JP | 2000-321858 | 11/2000 |

OTHER PUBLICATIONS

U.S. Appl. No. 10/823,688, filed Apr. 14, 2004, pending, Hirokoshi, et al.

U.S. Appl. No. 10/693,981, filed Oct. 28, 2003, pending, Tamura.

* cited by examiner

*Primary Examiner*—William J. Royer
(74) *Attorney, Agent, or Firm*—Fitzpatrick, Cella, Harper & Scinto

(57) ABSTRACT

It has sometimes been the case that when a developing device becomes inverted with the rotation of a rotary, a developer in the developing device flows out in a great deal through a discharge port. So, the height of the ceiling of an agitating chamber is made great in an area near the discharge port, it has become possible to prevent the excessive discharge of the developer from the developing device.

5 Claims, 15 Drawing Sheets

FIG. 7A
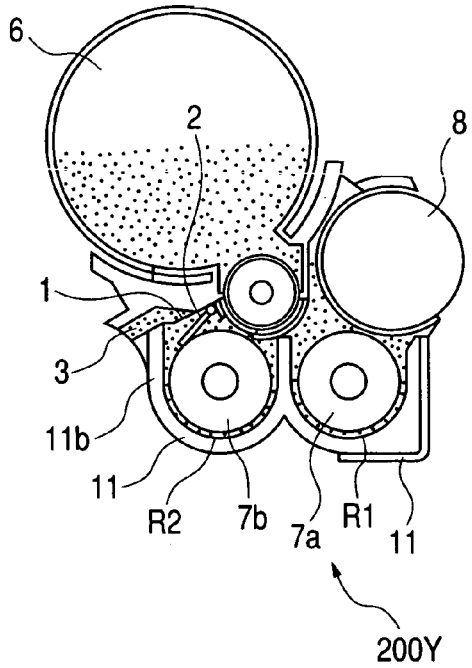
FIG. 7B
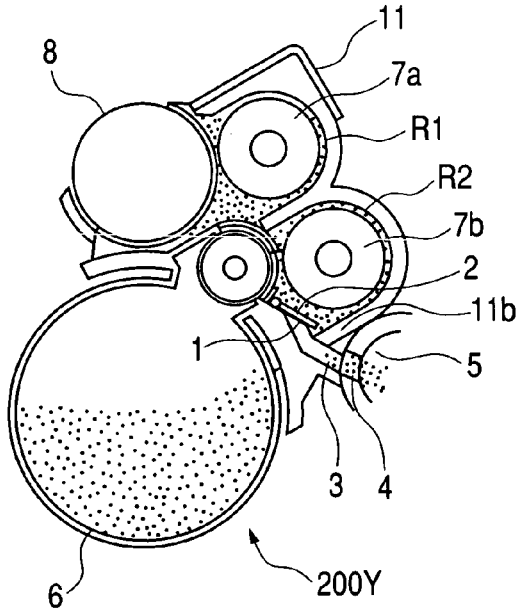
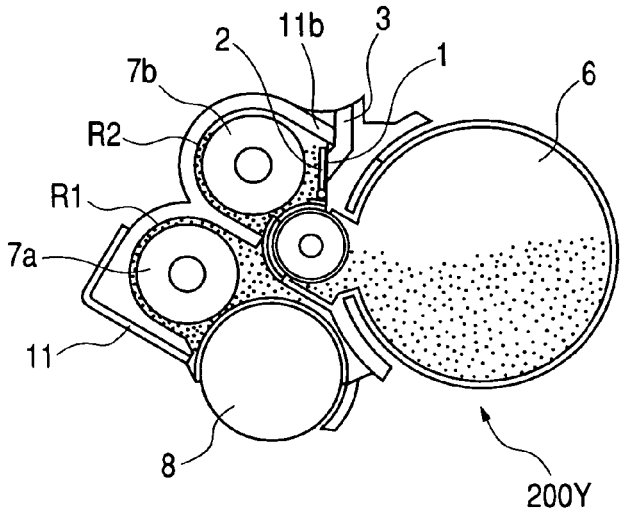
FIG. 7C

DEVELOPING APPARATUS INCLUDING A PLURALITY OF TWO-CHAMBER DEVELOPER CONTAINERS WHEREIN A CEILING HEIGHT OF THE SECOND CHAMBER IS HIGHER NEAR A DISCHARGE OPENING

BACKGROUND OF THE INVENTION

1. Field of the Invention

The invention relates to a developing apparatus for developing an electrostatic image formed on an image bearing member by an electrophotographic process, an electrostatic recording process or the like, and is for use, for example, in a copying machine, a facsimile apparatus, a printer or the like.

2. Description of the Related Art

Generally, in multi-color image forming, use is made of a technique of developing an electrostatic latent image formed in accordance with external information with developers of plural colors, successively forming developer images (toner images) of plural colors on a photosensitive member which is an image bearing member, and successively or collectively superimposing these toner images of the plural colors on a transfer medium such as paper.

In such a multi-color image forming apparatus, there is a rotational type developing apparatus or a rotary developing apparatus comprising developing apparatuses for developers of plural colors, e.g. black, yellow, magenta and cyan, mounted, for example, on a rotary member (rotational type developing member) along the rotational circumference thereof, and there has heretofore been proposed and put into practical use a so-called rotational developing process of rotating the rotational type developing member to thereby move a necessary developing apparatus to a developing position opposed to a photosensitive member which is an image bearing member and perform a developing operation.

On the other hand, in conventional image forming apparatuses of an electrophotographic-type, and above all, a multi-color image forming apparatus for effecting color image forming, there is widely utilized a two-component developing process using a mixture of a nonmagnetic toner and a magnetic carrier as a developer. The two-component developing process, as compared with presently proposed other developing processes, has merits such as the stability of the quality of image and the durability of the apparatus, while on the other hand, the deterioration of the developer due to long-period endurance, particularly the deterioration of the carrier has been unavoidable and therefore, the work of interchanging the developer has become necessary with the long-period use of the multi-color image forming apparatus, and this has brought about increases in service cost and running cost.

There have heretofore been proposed several methods of solving such a problem in a case where this two-component developer is applied to the rotary developing apparatus. For example, there is a method of loading a rotational type developing member with an interchangeable developer supplying cartridge as an accessory of the developing apparatus, and effecting the supply of a developer containing a toner and a carrier and the collection of the developer (see, for example, Japanese Patent Application Laid-Open No. H6-308829).

In this developing apparatus, however, there is adopted a structure for collecting the developer overflowing the developing apparatus into the developer supplying cartridge by the use of a plurality of screws and therefore, the apparatus becomes large-scale and a control mechanism also becomes complicated. Also, when the developing apparatus of such a construction and the developer supplying cartridge are carried on the rotational type developing member, the diameter of the rotational type developing member becomes large and the multi-color image forming apparatus becomes bulky. Further, a carrying route for the developer is complicated and when the developing member is rotated, there is the possibility of the developer leaking.

So, particularly in the rotational developing process, there is put into practical use a developer discharging process of supplying a two-component developer to the developing apparatus and discharging the two-component developer from the developing apparatus by the utilization of a change in a gravity acting direction resulting from the rotational motion of the rotational type developing member.

For example, Japanese Patent Application Laid-Open No. H9-218575, as shown in FIG. 10 of the accompanying drawings, discloses a rotational type developing apparatus 101 having four developing apparatuses 200 equally provided on a rotational type developing member 101' along the circumferential direction thereof. A developer cartridge 6 containing therein a developer to be supplied is provided in each of the four developing apparatuses 200. Design is made such that at a developing position P1 opposed to a drum-shaped photosensitive member (photosensitive drum) 113 as an image bearing member, the developer containing a toner corresponding to an amount consumed by a developing operation is supplied to the developing apparatus 200, and any excess developer in the developing apparatus 200 is discharged to the developer cartridge 6 by the utilization of a change in a gravity acting direction due to the rotation of the rotational type developing member 101'. That is, the supply and collection of the developer are effected by the utilization of rotational motion peculiar to the rotational type developing member 101' and therefore, structure is simple and any reduction in the charging ability of the carrier is prevented without causing the bulkiness of the multi-color image forming apparatus and a rise in cost.

On the other hand, in Japanese Patent Application Laid-Open No. H10-142888, as shown in FIG. 11 of the accompanying drawings, four developing apparatuses 200 are likewise provided in a rotational type developing member 101', and design is made such that at a developing position P1 whereat a developing apparatus 200 is opposed to a photosensitive drum 113, a developer discharged from the developing apparatus 200 is temporarily stored in a storing portion 70 protrudedly provided on an end portion of the developing apparatus 200, and is carried to the central cylinder shaft D0 of the rotational type developing member 101' by the utilization of a change in a gravity acting direction due to the rotation of the rotational type developing member 101', and is finally collected in a developer collecting container (not shown) provided on an end of the cylinder shaft D0 by a developer carrying member D1 in the cylinder shaft D0. That is, as in the multi-color image forming apparatus proposed in Japanese Patent Application Laid-Open No. H9-218575, the discharge of the developer is effected by the utilization of movement peculiar to the rotational type developing member 101' and therefore, any reduction in the charging ability of the carrier is prevented without causing the bulkiness of the multi-color image forming apparatus, and design is made such that even when single-color image forming is continued, at the developing position P1, any excess developer in the developing apparatus 200 is discharged to a storing portion 70 outside the developing apparatus 200 without the developing operation being stopped and therefore, the amount of developer in the developing apparatus 200 is maintained within an allowable value without image productivity being reduced.

In the developing apparatuses having the excess developer discharging construction as described above, there has been adopted a construction in which when the level of the developer has become higher than the prescribed level of the developer in a developing container, the developer is scooped out by the utilization of the rotational motion of the rotational type developing member (see, for example, Japanese Patent Application Laid-Open No. H9-218575), or a construction in which the excess developer is once collected in a storing portion, and then is collected in a location by the utilization of the rotational motion of the rotational type developing member (see, for example, Japanese Patent Application Laid-Open No. H10-142888).

Besides these, in the latent multi-color image forming apparatuses, a higher speed and a higher quality of image are required and toward a higher speed, the rotational speed of an image forming process system is heightened, that is, the rotational speed of an agitating member (developing screw) in the developing apparatus is heightened, and toward a higher quality of image, the rotational speed of the developing screw in the developing apparatus is heightened in an attempt to obtain uniform agitation.

With the market of full-color copying machines/printers having been enlarged in recent years and various functions being required, many multi-color image forming apparatuses having the compactness and lower cost of the apparatus and yet seeking after high image productivity have been produced and in the future as well, they seem to become one of the mainstreams of the market.

Also, when a higher speed is aimed at, the rotatable time of the rotational type developing member tends to be extremely shortened, and a shock applied to the developing apparatus tends to become great. Besides these, as the rotation stop positions of the rotational type developing member, usually in addition to a developing position during continuous image forming, there is a home position in which a developing sleeve is retracted to a location spaced apart from a photosensitive drum which is an image bearing member, as for a rotational type developing member of a type having a developer cartridge in the interior of the rotational type developing member, there is further a stop position exclusively for the interchange of the developer cartridge.

Under such a situation, it is self-evident that the art of a developing apparatus for effecting the supply of a developer containing a toner and a carrier and the collection of any excess two-component developer which is simple in structure and which prevents any reduction in the charging ability of the carrier and suppresses any increase in service cost and running cost without causing the bulkiness of the multi-color image forming apparatus and a rise in the cost thereof will also be positioned as important art in the future.

Now, as shown in FIGS. 10 and 11, in these developing apparatuses 200, there have been seen many constructions which have a first agitating chamber R1 on a developing sleeve side which is a developer carrying member (developing sleeve) 8 for carrying the developer to a developing area and a second agitating chamber R2 on a side having a supplying port and in which the developer is circulated between the first agitating chamber R1 and the second agitating chamber R2 by an agitating member 7.

If in such constructions, an excess developer discharge port 1 is provided on the first agitating chamber side, discharge can be hardly effected under the influence of the magnetic force of a magnet roll disposed in the developing sleeve 8, or the carrier which originally should be discharged will be sucked and only the toner which should not be discharged will be discharged. Also, even if the excess developer discharge port 1 could be disposed on the first agitating chamber side with a sufficient distance kept from the magnet roll, only the level of the developer near the discharge port 1 in the direction of the rotary shaft of the developing sleeve 8 will lower and the supply of the developer to the developing sleeve 8 will become little and only that portion will become low in density. Therefore, in the developing apparatuses described in the aforedescribed examples of the conventional art, it is often the case that the excess developer discharging construction is provided in the second agitating chamber R2.

In such an excess developer discharging mechanism, the excess developer discharging position of the developing apparatus 200 is set to the developing position P1. Accordingly, during excess developer discharge, the agitating member 7 in the developing apparatus 200 agitates and carries the two-component developer in the developing apparatus 200 while being rotated, and circulates the two-component developer in the developing apparatus 200.

Also, while a description has been made of the discharge of the two-component developer utilizing the force in the gravity acting direction resulting from the rotational motion of the rotational type developing member 101', the conventional art is not restricted to the rotational type developing member 101'.

As shown in FIGS. 15A and 15B, it has heretofore also been practiced to control the height of the developer level in an agitating chamber to thereby discharge the two-component developer. The developer stagnates by narrowing the screw pitch interval downstream of the discharge port. Thereby the height of the developer level in the discharge port swells and the developer exceeding a prescribed height is discharged.

However, in the conventional developing apparatuses 200 described in Japanese Patent Application Laid-Open No. H6-308829 and Japanese Patent Application Laid-Open No. H9-218575, if the number of revolutions of the agitating member 7 in the developing apparatus 200 is increased aiming at the recent higher speed and higher quality of image, it will gradually become difficult for the developer level in the developing apparatus 200 to be stable, and stable discharge will gradually become difficult.

Particularly, in a multi-color image forming apparatus having the rotational type developing member 101', the shortening of the rotated position changeover time of the rotational type developing member 101' is advanced to cope with the high productivity in recent years. In this case, the impact force during the start and stop of the rotation of the rotational type developing member 101' tends to become great, but in the other rotation modes than a continuous image forming operation, there is often seen a case where an acceleration-deceleration curve is set gently in an attempt to make the impact force small. In a case where the rotational type developing member 101' has a plurality of rotation modes as described above, the instability of the discharging mechanism resulting from an increase in the rotation stop position tends to be further promoted.

This is because the developer level state in the developing apparatus 200, as compared with a case where the agitating member 7 has been rotated from the horizontal stationary state of the developing apparatus 200, remarkably differs in situation in a case where the agitating member 7 has been rotated from a state accompanied by the revolving operation of the rotational type developing member 101', and much time is taken until the developer level state becomes stable at an ordinary developer level from the start of the rotation of the agitating member 7.

Also, in the conventional excess developer discharging construction, it sometimes happens that during the time until the level of the developer becomes stable, the developer being at a position higher than a predetermined developer level is discharged in spite of being not the excess developer.

Now, in multi-color image forming apparatuses having a rotational type developing member, there has often been seen a construction in which a developing sleeve provided in a developing apparatus is stopped and is made to wait at a phase position (so-called home position) in which it is not opposed to a photosensitive drum so that the photosensitive drum may not be adversely affected by the strong magnetic force of the developing sleeve when the image forming operation is not being performed.

Also, when the rotational type developing member assumes a construction including a developer cartridge 6 constituted by a toner bottle containing therein a developer to be supplied, there has been seen a case where the phase position at which the developing member is stopped and waits in order to interchange the developer cartridge 6 is provided at a phase position discrete from a developing position and a home position stop and waiting position.

When such a construction is adopted, a plurality of stop and waiting positions further become necessary besides the developing positions for respective colors. For example, the stop positions of a rotational type developing member holding developing apparatuses for four colors are not restricted to four positions, i.e., 0 degree as the developing position, and 90 degrees, 180 degrees and 270 degrees therefrom, but unavoidably the construction must have a plurality of stop positions in addition to these.

Not to speak of a case where a three-color rotary construction (in this case, equal rotations by 120 degrees+$\alpha$) is adopted when in view of the recent use situation of offices, an attempt is made to develop a multi-color image forming apparatus laying emphasis on black-and-white continuous images, or a case where there are given toner cartridge interchanging positions which are unequal from the stop position during ordinary continuous image forming, it is already becoming an indispensable technique for the rotational type developing member to be stopped at a plurality of rotation stop positions.

However, both of the multi-color image forming apparatus described in Japanese Patent Application Laid-Open No. H9-218575 and the multi-color image forming apparatus described in Japanese Patent Application Laid-Open No. H10-142888 are of a construction in which the developers are made to fall by the utilization of a change in the gravity direction by the rotational movement of the rotational type developing member and therefore, it sometimes happens that the more are increased the rotation stop positions, the more unstable becomes the height position of the developer level, and unexpected discharge takes place or the developer cannot be discharged when it should be discharged, and it becomes difficult to maintain a high quality of image. It is because of a construction in which during a continuous image forming operation, the aforedescribed developing stop position visits periodically stably, whereas the home position waiting position visits only after the termination of the job, and the developer cartridge interchange stop and waiting position visits only when the amount of the toner in the cartridge has become small.

If an attempt is made to obtain a discharging characteristic which includes all these conditions and yet is stable, very much time is required for the setting of the conditions, and this has greatly affected the shortening of the developing period.

In the multi-color image forming apparatuses described in the aforementioned Japanese Patent Application Laid-Open No. H9-218575 and Japanese Patent Application Laid-Open No. H10-142888, the deteriorated developer is discharged into the developer cartridge by the utilization of the rotational motion of the rotational type developing member and therefore, structure is simple, and the bulkiness and high cost of the multi-color image forming apparatus are not caused, and the deteriorated developer is gradually replaced with a fresh developer to thereby stabilize the characteristic as the entire developer.

However, although the interchange of the developers becomes unnecessary and the maintenance property is improved, the rotating operation of the rotational type developing member must be performed to stably discharge the excess developer in the developing apparatus to the outside of the developing apparatus, and under the influence of the instability of the level of the developer in the developing apparatus resulting from the increase in the number of the rotation stop positions, a great reduction in image productivity could not be avoided.

Also, these multi-color image forming apparatuses are of a construction in which a storing portion must be discretely provided in the developing apparatus, and such construction, in spite of being an unnecessary member for ordinary image forming, need be contrived to ensure good discharge as the number of the rotation stop positions is increased as described previously, and it is unavoidable for the construction to gradually become complicated and large-scale, and the complication of the multi-color image forming apparatus and a rise in the cost thereof could not be avoided.

However, both of the multi-color image forming apparatus described in Japanese Patent Application Laid-Open No. H9-218575 and the multi-color image forming apparatus described in Japanese Patent Application Laid-Open No. H10-142888 are of a construction in which the developers are made to fall by the utilization of a change in the gravity direction by the rotational movement of the rotational type developing member and therefore, it sometimes happens that the more are increased the rotation stop positions, the more unstable becomes the height position of the developer level, and unexpected discharge takes place or the developer cannot be discharged when it should be discharged, and it becomes difficult to maintain a high quality of image. It is because of a construction in which during a continuous image forming operation, the aforedescribed developing stop position visits periodically stably, whereas the home position waiting position visits only after the termination of the job, and the developer cartridge interchange stop and waiting position visits only when the amount of the toner in the cartridge has become small.

Besides these, in the aforedecribed excess developer discharging construction, such parameters as the height and area of the discharge port, the number of revolutions and pitch of the agitating member are conceivable as parameters which can set conditions to obtain a desired developer discharge amount, but the number of revolutions and pitch of the agitating member greatly affect the two-component developer supplied to the developing sleeve (the higher speed progressed for the higher quality of image is a good example of it) amd therefore, it has been impossible in reality to change these parameters for the adjustment of the excess developer discharge amount. Thereupon, after all, the parameters which can set conditions are restricted to such limited conditions as the height and area of the discharge port, and it is the present situation that actually sufficient condition setting could not be done due to a combination of other design factors.

That is, in the conventional art, the work of interchanging the developer becomes unnecessary and the maintenance property is improved, but is has been difficult to obtain a stable high image quality maintaining characteristic, and it has been impossible to realize both of the simplification and lower cost of the multicolor image forming apparatus and high image productivity at a time.

SUMMARY OF THE INVENTION

It is an object of the present invention to provide a developing apparatus which can properly discharge any excess developer from a discharge port even when the level of a developer becomes unstable.

It is another object of the present invention to provide a developing apparatus comprising:

a developing container for containing developer including toner and a carrier, the developing container having a first chamber for developing an electrostatic image formed on an image bearing member, and a second chamber constituting a circulation route for the developer between the second chamber and the first chamber;

a carrying member for carrying the developer in the second chamber;

an opening portion provided in a side of the second chamber for permitting the overflow of an excess developer with the supply of the developer; and a rotary member rotatable with a plurality of developing containers held thereon, the rotary member being adapted to selectively position a desired developing container at a developing position, wherein the height of the ceiling of the second chamber is made great in an area corresponding to the opening portion.

Other objects of the present invention will become apparent from the following detailed description when read with reference to the accompanying drawings.

BRIEF DESCRIPTION OF THE DRAWINGS

FIGS. 7A, 7B and 7C are illustrations showing the behavior of the shutter member in a change in the position of the developing apparatus according to the present invention.

DESCRIPTION OF THE PREFERRED EMBODIMENTS

A developing apparatus and an image forming apparatus according to the present invention will hereinafter be described in greater detail with reference to the drawings.

First Embodiment

Figure 1:
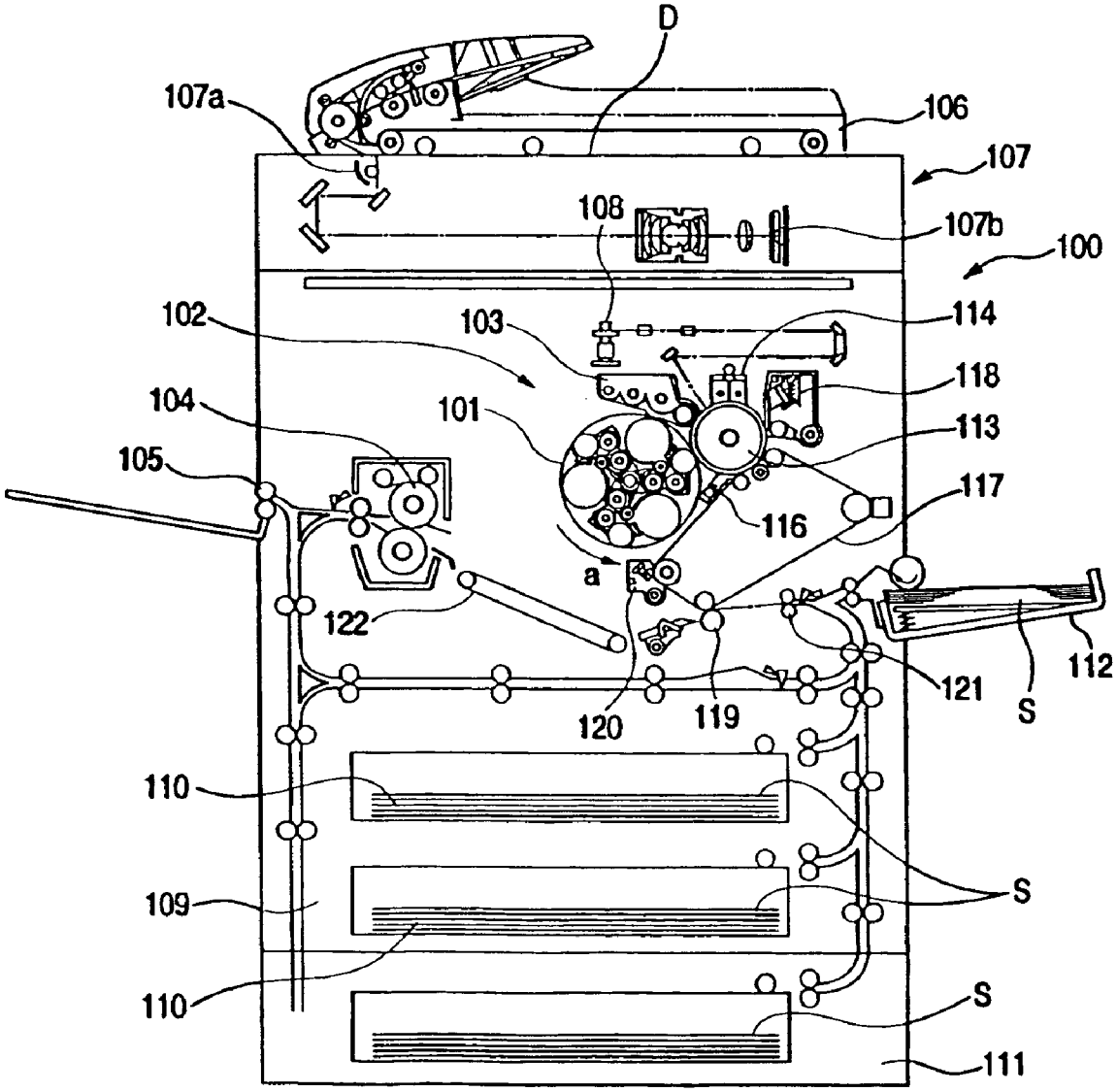
FIG. 1 schematically shows the construction of an example of an image forming apparatus according to the present invention.

FIG. 1 shows an example of a multi-color image forming apparatus (color copying machine) provided with a rotational type developing member in an embodiment of the present invention.

An apparatus main body 100 shown in FIG. 1 is a multi-color image forming apparatus having a rotary developing apparatus 101 which is a rotational type developing apparatus which is most characteristic in the present invention.

The apparatus main body 100 is provided with a document supporting stand 106, a light source unit 107, a laser scanner unit 108, a sheet feeding portion 109 and an image forming portion 102.

The sheet feeding portion 109 has cassettes 110, 111 and a manually feeding cassette 112 containing transfer materials S therein and detachably attachable to the apparatus main body 100, and the transfer materials S are supplied from these cassettes 110, 111 and manually feeding cassette 112.

The image forming portion 102 has the function of forming a developer image (toner image) on the surface of a photosensitive drum 113 as an image bearing member, and transferring it to the transfer material S, and has disposed therein a singly constructed black developing apparatus 103, the cylindrical photosensitive drum 113, a primary charging device 114, the rotary developing apparatus 101 containing therein color developing apparatuses 200Y, 200M and 200C for three colors made integral with developer cartridges 6, a post-charging device 116 for adjusting the quality of image after development, an endless ring-shaped transfer belt 117 onto which toner images of four colors are superimposed and transferred, and thereafter from which a multi-color image is transferred to the transfer material 5, a drum cleaner 118 for removing any residual toners on the photosensitive drum 113, a secondary transfer roller 119 for transferring the toner images from the transfer belt 117 to the transfer material S, and a belt cleaner 120 for removing any residual toners on the transfer belt 117.

Figure 2:
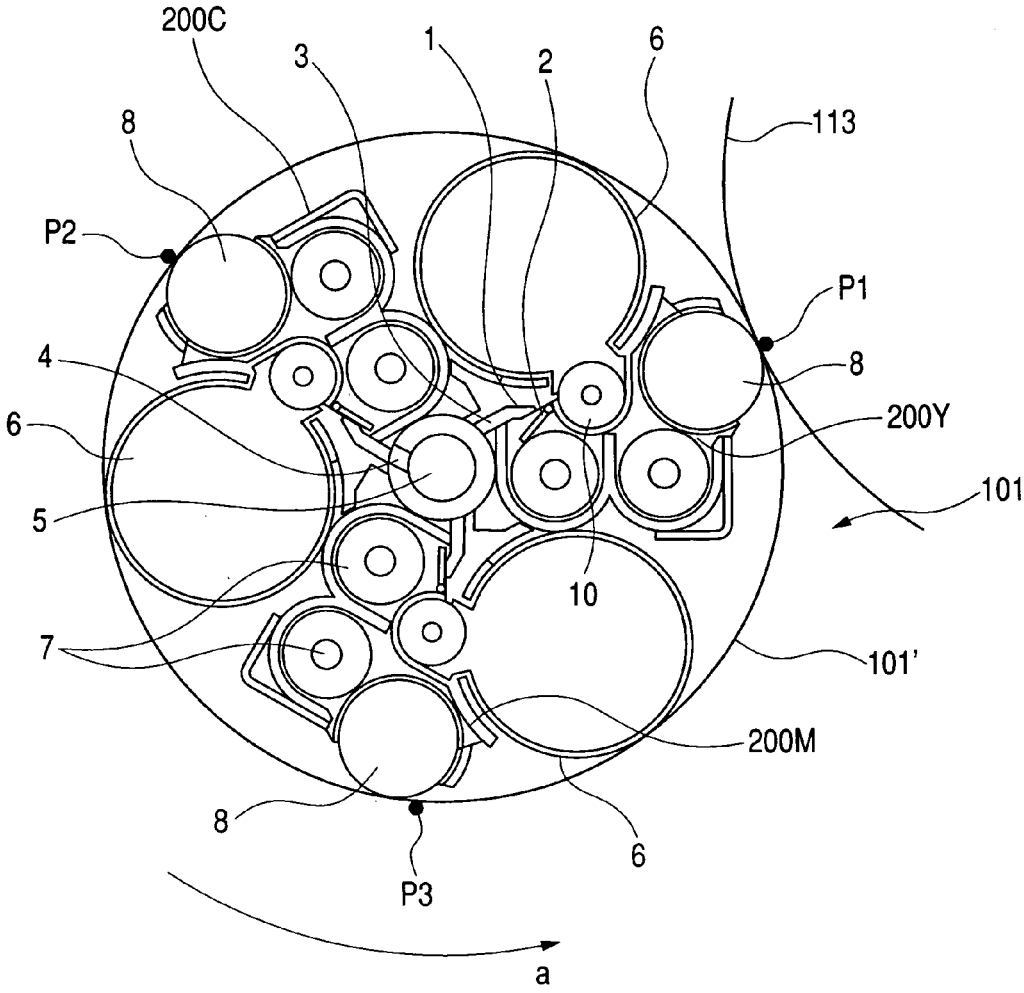
FIG. 2 is a cross-sectional view showing an example of a rotary member (rotational type developing apparatus) carrying thereof developing apparatuses according to the present invention.

As shown in FIG. 1, in the present embodiment, the black developing apparatus 103 and the rotary developing apparatus 101 are disposed in the image forming portion 102, and the rotary developing apparatus 101, as shown in FIG. 2, is of a construction having developing apparatuses 200 for three colors, i.e., a developing apparatus 200Y for yellow, a developing apparatus 200M for magenta and a developing apparatus 200C for cyan, in a rotational type developing member 101'. The three developing apparatuses 200Y, 200M and 200C are similar in construction to one another except for the colors of the developers.

As what connects the image forming portion 102 and the sheet feeding portion 109 with each other, there are installed registration rollers 121 for enhancing the accuracy of the posture position of the transfer material S, and feeding out the transfer material S at good timing in accordance with the toner image transferred onto the transfer belt 117, and downstream of the image forming portion 102 with respect to the conveying direction of the transfer material S, there are disposed a transfer conveying apparatus 122 for conveying the transfer material S to which the toner image has been transferred, a fixing apparatus 104 for fixing the unfixed image on the transfer material S, discharge rollers 105 for discharging the transfer material S on which the image has been fixed to the outside of the multi-color image forming apparatus.

The operation of this multi-color image forming apparatus will now be described.

When a sheet feeding signal is outputted from a controller (not shown) provided on the apparatus main body side, a transfer material S is supplied from the cassette 110 or 111 or the manually feeding cassette 112. On the other hand, in the upper portion of the apparatus main body 100, the light source unit 107 has a light source 107*a* and a CCD unit 107*b* including a CCD, and light applied from the light source 107*a* to and reflected from a document D placed on the document supporting stand 106 is once read by the CCD unit 107*b*, and thereafter is converted into an electrical signal, and is replaced by a laser beam in the laser scanner unit 108 and is applied onto the photosensitive drum 113.

The photosensitive drum 113 is charged in advance by the primary charging device 114, and by the light being applied thereto, an electrostatic latent image is formed thereon, and then a black toner image is formed thereon by the black developing apparatus 103.

The toner image formed on the photosensitive drum 113 has its potential adjusted by the post-charging device 116, and is soon transferred onto the transfer belt 117 at a transferring position. When the image to be formed is a color mode, the transfer belt 117 is further rotated by one rotation so that the next toner image may be formed and transferred thereto. In the meantime, the rotational type developing member 101' of the rotary developing apparatus 101, in order to prepare to form the first toner image, rotates the developing apparatus 200 for a designated color in the direction indicated by the arrow "a" so as to be opposed to the photosensitive drum 113, and prepares to develop the next electrostatic latent image. Thus, the forming and developing of the electrostatic latent image and the transferring of the developed image are repeated until a predetermined number of toner images in a full-color mode have been transferred.

Reference is now had to FIG. 2 to describe the construction of the rotary developing apparatus 101 having the color developing apparatuses 200 carried in the rotational type developing member 101' in the present invention.

As previously described, the rotary member (rotational type developing member) 101' has therein three developing apparatuses 200 similar in construction to one another, i.e., the developing apparatus 200Y for yellow, the developing apparatus 200M for magenta and the developing apparatus 200C for cyan, and the rotational type developing member 101' is freely rotatable by a motor (not shown).

The rotational type developing member 101', in its initial state, is stopped at a rotated position 60° short of a developing position P1 in which the photosensitive drum 113 and the developing apparatus 200Y for yellow are proximate to each other. This is for causing a developing sleeve 8 provided in the developing apparatus 200 for each color to stop and wait at a phase position farthest from the photosensitive drum 113 so that the photosensitive drum 113 may not be adversely affected by the strong magnetic force of the developing sleeve 8 which is a developing carrying member.

When a developing operation is to be performed on the photosensitive drum 113 to thereby form a full-color toner image, the developing apparatus 200Y for yellow is rotated by 60° to the developing position P1 proximate to the photosensitive drum 113 after the termination of the developing by the black developing apparatus 103, thereby effecting development.

Subsequently, in order to form a toner image of another color, the rotational type developing member 101' is rotated by 120° to thereby dispose the developing apparatus 200M for magenta at the developing position P1, and likewise effect development, and the forming of a cyan toner image is effected in a similar manner. When the developing operation in the respective colors are terminated, the rotational type developing member 101' is rotated by 60° to again wait at the home position, and comes to wait for the start of the next job.

Now, the transfer material S fed from the sheet feeding portion 109 has its skew feed corrected by the registration rollers 121, and is further fed to the image forming portion 102 in timed relationship with the forming of the toner images. Then, the toner images are transferred to the transfer material S by the secondary transfer roller 119, and the separated transfer material S is conveyed to the fixing apparatus 104 by the conveying apparatus 122, and the unfixed transferred image is permanently fixed on the transfer material S by the heat and pressure of the fixing apparatus 104. The transfer material S on which the image has been fixed is discharged from the apparatus main body 100 by the discharge rollers 105.

In this manner, in the present image forming apparatus 100, the transfer material S fed from the sheet feeding portion 109 has an image formed thereon and is discharged.

When black-and-white image forming is to be effected, the toner image formed on the photosensitive drum 113 by the black developing apparatus 103 containing the black toner therein is primary-transferred onto the transfer belt 117, whereafter it is immediately secondary-transferred onto the transfer material S, and the transfer material S stripped off from the transfer belt 117 is conveyed by the conveying apparatus 122, and is pressurized/heated by the fixing apparatus 104 to thereby provide a permanent image. The single-color image forming by this process is about four times as high in image productivity as full-color image forming.

The structure of the color developing apparatuses 200Y, 200M and 200C provided in the rotary developing apparatus 101 which is the rotational type developing apparatus, and a discharging mechanism for excess developers when two-component developers are used therein which is a characteristic portion of the present embodiment will now be described in detail with reference to FIGS. 3, 4, 5A and 5B with the developing apparatus 200Y for yellow taken as an example.

The developing apparatus 200M for magenta and the developing apparatus 200C are also similar in construction and function to the developing apparatus 200Y for yellow.

Figure 3:
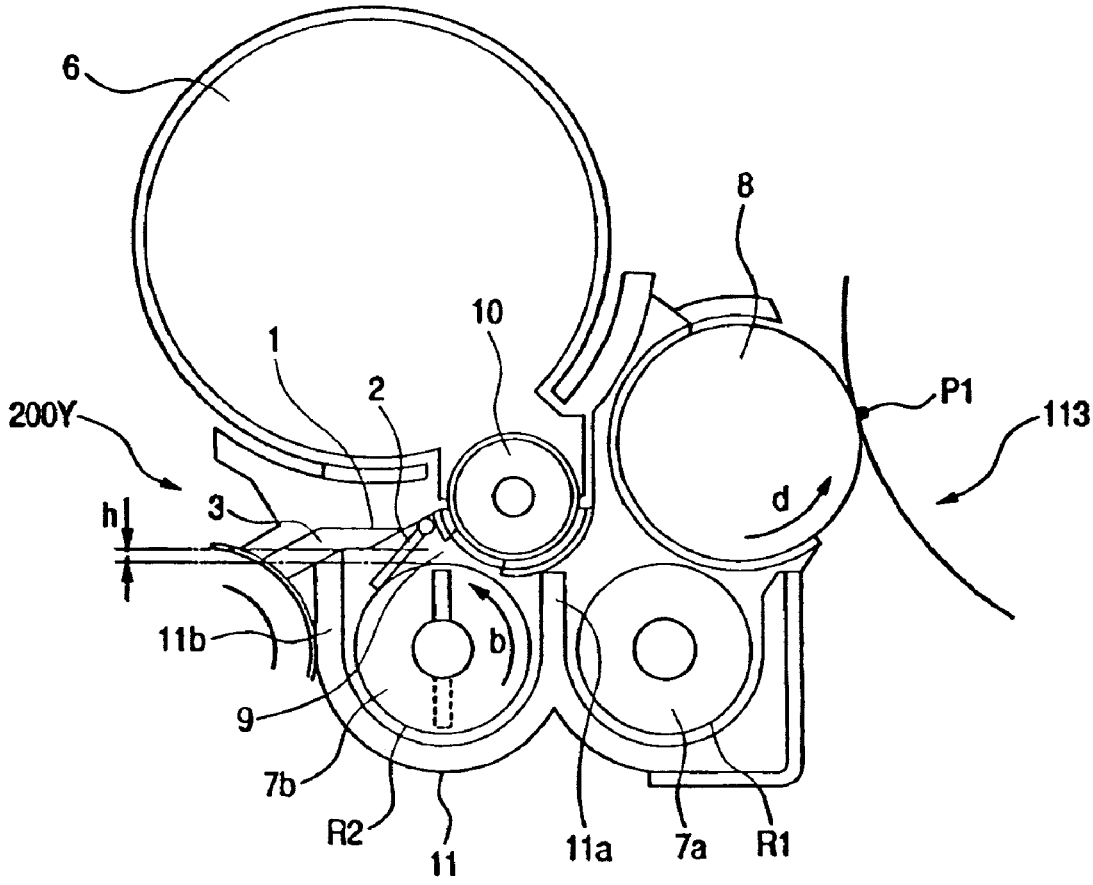
FIG. 3 is a cross-sectional front view showing an example of the developing apparatus according to the present invention.
Figure 4:
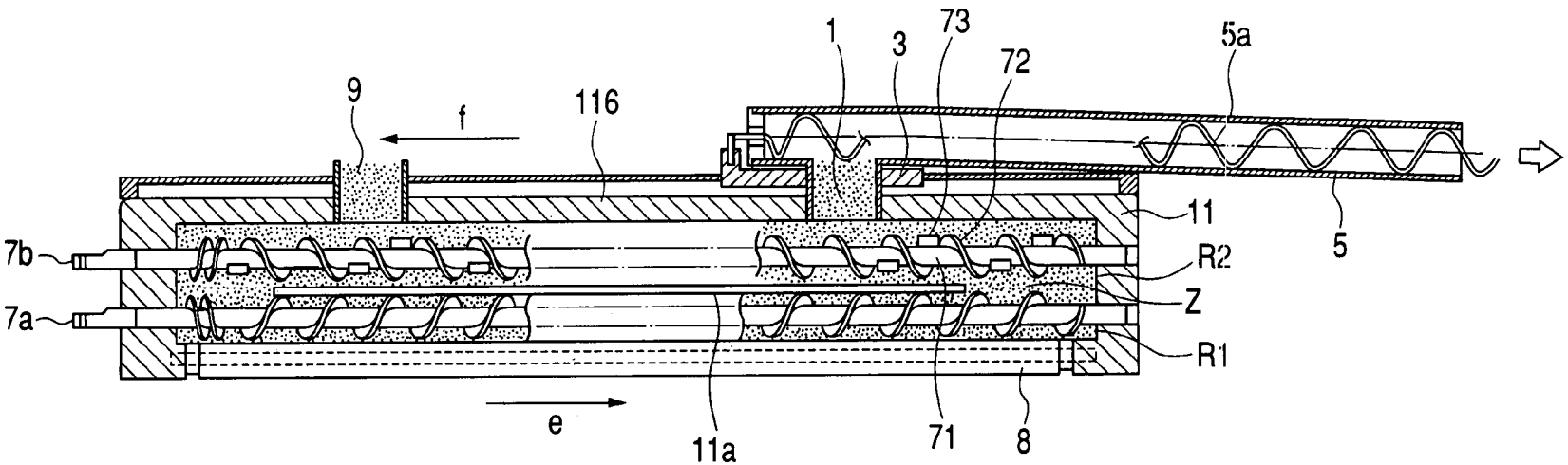
FIG. 4 is a top cross-sectional view showing an example of the developing apparatus according to the present invention.
Figure 5B:
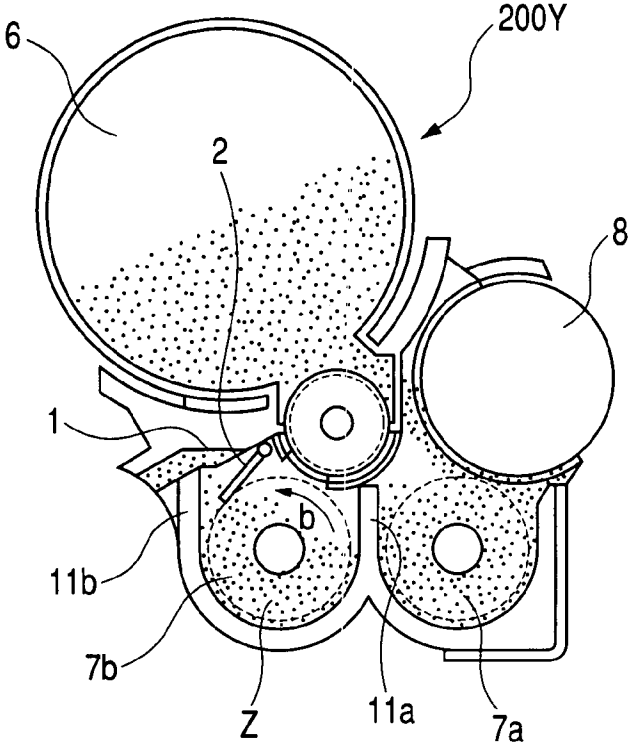
FIGS. 5A and 5B are illustrations showing the behavior of a developer in the developing apparatus according to the present invention.
Figure 5A:
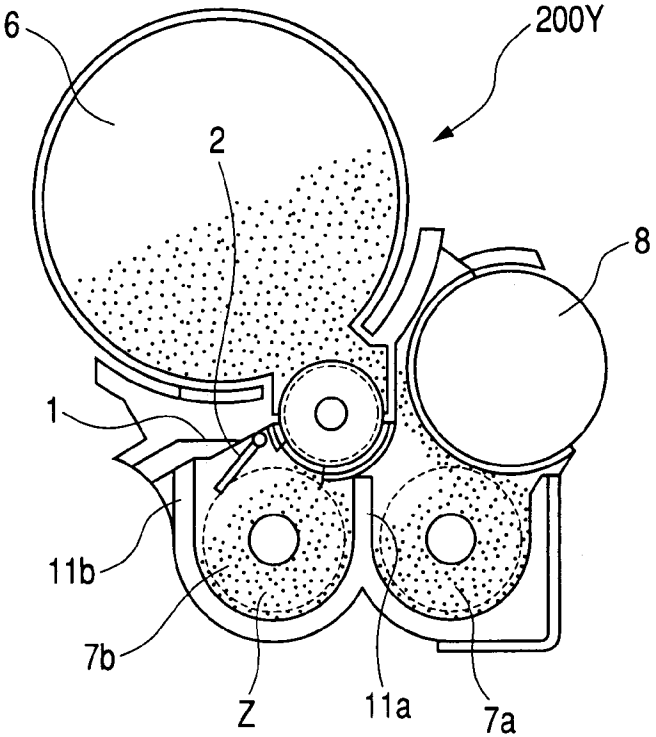

FIG. 3 is a cross-sectional front view of the developing apparatus 200Y in the present embodiment, FIG. 4 is a top view showing the construction of the essential portions thereof, and FIGS. 5A and 5B illustrate the nondriven state and driven state, respectively, of the developing apparatus 200Y.

As shown in FIGS. 3 and 4, the developing apparatus 200Y is such that a developing container 11 containing the developer therein is divided into two portions, i.e., a first agitating chamber R1 and a second agitating chamber R2 provided in parallelism to the photosensitive drum 113, and in a state in which the developing apparatus 200Y is in the developing position P1 ready to perform the developing operation, the first agitating chamber R1 is nearer to the photosensitive drum 113 and the second agitating chamber R2 is farther from the photosensitive drum 113. In the present embodiment, the first agitating chamber R1 and the second agitating chamber R2 are disposed side by side in a horizontal direction at the developing position P1.

The developing apparatus 200Y opens at a developing area opposed to the photosensitive drum 113, and the developing sleeve 8 is rotatably disposed in such a maimer as to be partly exposed in this opening portion. The developing sleeve 8 is formed of a nonmagnetic material, contains therein a stationary magnet (magnet roll) which is a magnetic field generating means, is rotated in the direction indicated by the arrow "d" in FIG. 3 during the developing operation, holds the two-component developer in the developing apparatus 200Y in a layer shape and carries it to the developing area, supplies the two-component developer to the developing area opposed to the photosensitive drum 113 and develops the electrostatic latent image on the photosensitive drum 113. The two-component developer after having developed the electrostatic latent image is carried in accordance with the rotation of the developing sleeve 8 and is collected into the developing apparatus 200Y.

The developing sleeve 8 is provided on the first agitating chamber R1 side. Also, the first agitating chamber (the developing sleeve side) and the second agitating chamber R2 (the supplying and discharging side) are partitioned by a partition plate 11*a*, and developing screws 7 (7*a*, 7*b*) which are agitating members are disposed in the first agitating chamber R1 and the second agitating chamber R2, respectively. The developer is agitated by screws 7 while being circulated in the first agitating chamber R1 and the second agitating chamber R2, and maintains a uniform state. Herein, description will be added with the developing screw 7*a* on the first agitating chamber side and the developing screw 7*b* on the second agitating chamber R2 side as 7*b*.

The developing screw 7, as shown in FIG. 4, has a rotary shaft 71 parallel to the developing sleeve 8, and a helical auger 72 which is a helical vane member is provided on the rotary shaft 71. The developing screws 7*a* and 7*b* are provided with helical augers 72 in opposite directions, and are rotated in the same direction to thereby carry the developer in opposite directions.

The two-component developer in the developing container 11 is earned in the direction indicated by the arrow "e" in FIG. 4 by the first developing screw 7*a* (the first agitating chamber side) as a carrying member and in the direction indicated by the arrow "f" (a direction opposite to the direction indicated by the arrow "e") in FIG. 4 by the second agitating screw 7*b* (the second agitating chamber side) as a carrying member, whereby it is circulated in the developing container 11 and is mixed and agitated.

In order to more enhance the agitating action for the developer in the second agitating chamber R2, an agitation promoting plate 73 which is a plate-shaped agitation promoting member is disposed besides the helical augers 72 for carrying chiefly the developer Z in the developing container 11 so that the developer Z may be sufficiently agitated and mixed.

Now, the two-component developer Z containing a nonmagnetic toner and a magnetic carrier is contained in the developing container 11, and the toner density in the developer in its initial state is of the order of 8% by weight ratio. This value should be properly adjusted in accordance with the charge amount of the toner, the particle diameter of the carrier, the construction of the multi-color image forming apparatus, and need not always be compulsory.

The two-component developer containing an amount of toner consumed by image forming is supplied from the developer supplying port 9 of a developer cartridge 6 into the developing apparatus 200Y by the rotational force of a supplying screw 10 and gravity. The mixing ratio of the toner and carrier of 9:1 by weight ratio, but is not particularly restricted to this numerical value.

That is, as compared with the ratio of the two-component developer in the developing container 11, the amount of toner is overwhelmingly great, and considering the volume ratio, it can also be considered that a slight amount of carrier is mixed with the toner. That is, when the toner consumed by image forming is to be made up for, a slight amount of carrier is gradually supplied. If the rate of the carrier in the supplied developer becomes great, the amount of replacement of the carrier will become great for the same amount of toner supply, and the two-component developer in the developing apparatus 200Y will approximate to a fresh state, but correspondingly the amount of consumption of the carrier will become great, and this leads to an increase in running cost. Therefore, it is preferable to discretely determine a suitable mixing ratio in each apparatus.

Also, the amount of supply of the developer is roughly determined by the number of revolutions of a supplying screw 10 provided in the developer supplying port 9 of the developer cartridge 6, and this number of revolutions in turn is determined by toner supply amount controlling means (not shown).

When the developing apparatus 200Y is in the developing position P1, that is, when the carrier is supplied to the developing apparatus 200Y at each termination of image forming and particularly, a high-density image is to be formed, a great amount, i.e., about several tens of mg of carrier is supplied and therefore, the amount of developer in the developing apparatus 200Y is increased and the level of the developer becomes high.

When the level of the developing becomes higher than the second developer screw 7*b*, the second developing screw 7*b* cannot sufficiently agitate the developer and therefore, the toner immediately after supplied is carried to the first developing screw 7*a* while remaining not sufficiently charged, and is used for the developing operation. Therefore, toner fogging occurs to an image blank (white background) portion, and when the amount of developer is further increased, the developer overflows the developing container 11 and contaminates the interior of the multi-color image forming apparatus.

As will be seen also from FIG. 2, in the developing apparatus 200Y, an excess two-component developer discharge port 1 is disposed in the second agitating chamber R2, and a shutter member 2 for controlling the discharge portion of the excess two-component developer is disposed near the discharge port 1, and a collecting port 3 for collecting the excess two-component developer is provided in the rotational type developing member 101'.

As shown in FIG. 3, the developer discharge port 1 is disposed at a height of a predetermined distance h from the upper end of the second circulating screw 7*b*, and at the developing position P1, the developer discharge port 1 is opened by the shutter member 2. The predetermined distance h is a height determined by the number of revolutions of the developing screw 7*b*, the pitch of the helical augers 72 and the shape of the agitation promoting plate 73. In the case of the present embodiment, this distance is set to 1.5 mm and a good stable discharging characteristic is obtained.

Also, the developer discharge port 1 is provided at a position higher than the uppermost portion of the developing screw 7*b* in the vertical direction thereof and in a developing container wall surface 11*b* downstream of the partition plate 11*a* with respect to the direction of rotation of the developing screw 7*b*.

By adopting such a construction, when the level of the developer becomes higher than the second developing screw 7*b*, the excess developer overflows the developer discharge port 1 and is discharged therefrom, and the level of the developer is maintained at the height of the second developing screw 7*b*. Therefore, the toner fogging of the above-mentioned image blank (white background) portion and the overflow of the developer from the developing apparatus 200Y do not happen.

As shown in the top view of the essential portions of FIG. 4 showing the developing container 11 as it is seen from above it, in the second agitating chamber P2, the developer discharge port 1 is disposed near the second developing screw 7*b* and upstream of the developer supplying port 9 with respect to a developer circulation direction f. Therefore, the circulation of the developer near the developing sleeve 8 is not disturbed, and it never happens that the developer just supplied is discharged.

Also, as will be seen from FIGS. 2, 3 and 4, in the discharge port 1, there is provided a collecting path which is a discharge path for communicating the discharge port 1 with a developer collecting pipe 5, and once storing therein the excess two-component developer discharged from the developing apparatus 200Y and discharging it, and the excess two-component developer collected from the collecting port 3 is carried from the developer collecting pipe 5 to the outside of the rotational type developing member 101'.

A carrying member 5*a* is rotatably disposed in the developer collecting pipe 5 so that the collected developer can be carried to the outside of the rotational type developing member 101' by drive transmitting means, not shown.

In the present embodiment, in FIG. 2, the position for collecting the excess two-component developer into the developer collecting pipe 5 is defined as P2 moved from the same P1 as the developing position, and rotated by 120° from the developing position P1, but the position P2 for collecting the excess developer into the developer collecting pipe 5 is not particularly restricted. It is also within the purport of the present invention to once store the excess developer in the collecting port 3, and collect it into the developer collecting pipe side at another position.

That is, the developing apparatus 200Y is provided with the developer supplying port 9 at one end of the upper wall of the developing container 11 near the second developing screw 7*b*, and the developer discharge port 1 having the shutter member 2 at the other end of the upper wall, and communicates with the developer collecting path 3, the other end of which communicates with the collecting pipe 5. Also, since the developer discharge port 1 is disposed at the height of the predetermined distance h from the upper portion of the developing screw 7*b* and upwardly opens, it never happens that with an increase in the amount of two-component developer in the developing container 11, the level of the developer becomes higher than the second developing screw 7*b*.

It is functionally important that the level of the developer near the discharge port 1 be lower than the level of the developer upstream and downstream of the aforementioned vicinity. So, as will be described later, design is made such that the developer carrying ability of the screw 7*b* in an area near the discharge port 1 becomes greater than the developer carrying ability of the screw 7*b* in areas upstream and downstream of the discharge port 1 with respect to the developer carrying direction.

Therefore, as shown in FIGS. 14A, 14B, 14C and 14D, the developer supplied from the supplying port 9 assumes such a concave shape that the level of the developer near the discharge port 1 becomes low and thus, when the amount of developer in the second agitating chamber R2 is increased with the supply of the developer, the excess amount of developer to be discharged appears sensitively at a point A downstream of the discharge port 1 with respect to the developer carrying direction.

The excess amount of developer having appeared at the point A, when further increase (FIG. 14B→FIG. 14C→FIG. 14D), overlaps the discharge port 1, and finally falls and is discharged to the outside of the developing apparatus.

Also, the level of the developer on the downstream side 501 of the discharge port 1 with respect to the developer carrying direction is high and therefore, the developer near the discharge port 1 can be discharged up to an amount to be discharged. Thus, this construction is a concept that the high level of the developer laterally moves and is discharged.

Thus, design is made such that the carrying ability of the screw 7*b* is set, whereby the discharge of the excess developer resulting from the supply of the developer is effected with good sensitivity.

As compared with the conventional process of discharging the developer at a predetermined height or greater, the present process is sensitive to any change in the amount of developer in the developing container 11 and can therefore reliably discharge the excess developer when it should be discharged.

In order to realize the above-described height of the level of the developer, in the present embodiment, the shape of the developing screw 7*b* near the level of the developer is changed. That is, the agitation promoting plate 73 is attached to the developing screw 7*b* upstream and downstream of the vicinity of the discharge port 1, whereby the developer tends to stagnate. This is because unlike the helical auger 72, the agitation promoting plate 73 has no thrust to the developer and therefore the speed of the developer weakens. Also, the agitation promoting plate 73 is absent near the discharge port 1 and therefore, the carrying of the developer becomes speedy and it becomes possible to make the height of the level of the developer low. In the present embodiment, two pairs of agitation promoting plates 73 across each other at 90 degrees.

As another realizing means, there is a technique of making the cross-sectional areas of the developing screw 7*b* different from one another. This is also possible by making the vicinity of the discharge port 1 thinner than the upstream and downstream portions.

Further, there is the partition plate 11*a* between the developing screws 7*a* and 7*b*. There are communicating portions 500 and 502 at the opposite ends of the partition plate 11*a* in order to circulate the developer in the developing container 11 divided by the partition plate 11*a*. The width of the communicating portion 500 near to the discharge port 1 is made narrower than that of the communicating portion 502, whereby the toner stagnates, and this is more effective to heighten the level of the developer downstream of the discharge port 1.

Figure 14A:
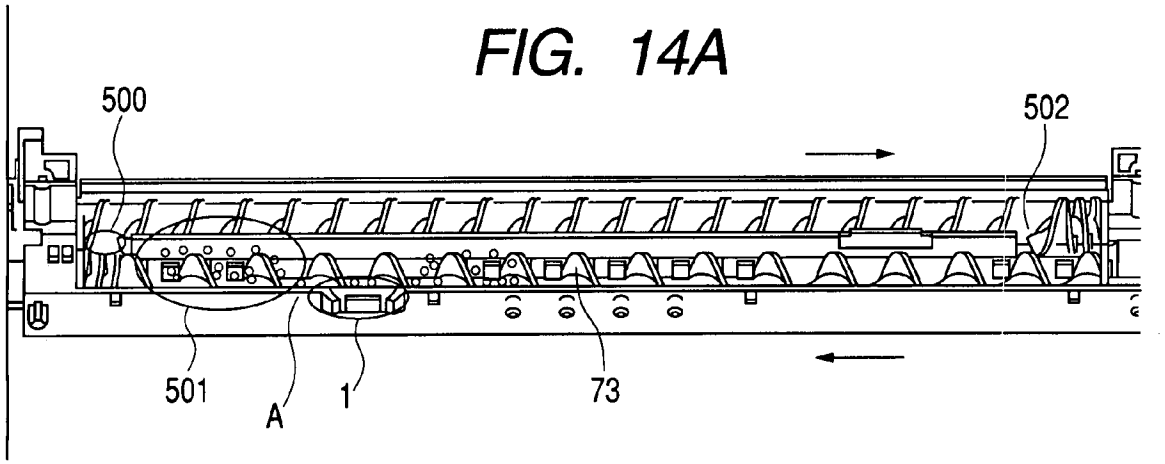
FIGS. 14A, 14B, 14C and 14D are illustrations showing another example of the developing apparatus according to the present invention.
Figure 14B:
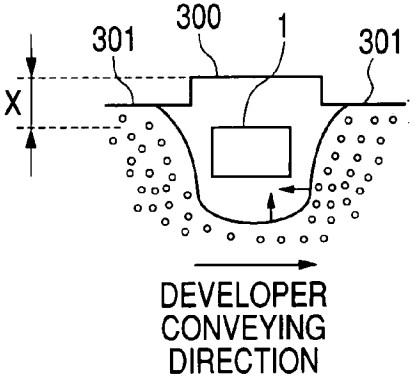
Figure 14C:
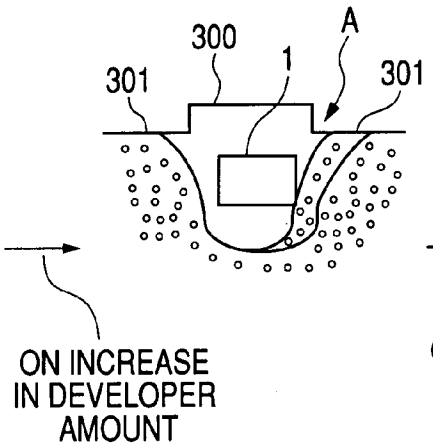
Figure 14D:
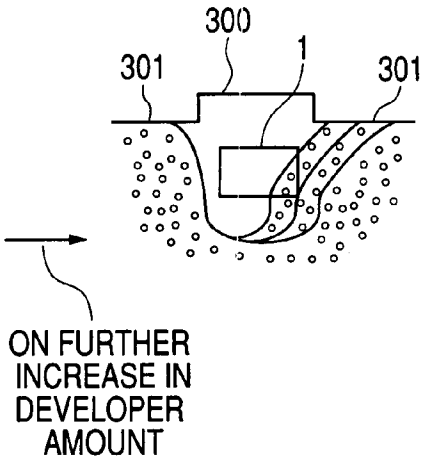
Figure 15A:
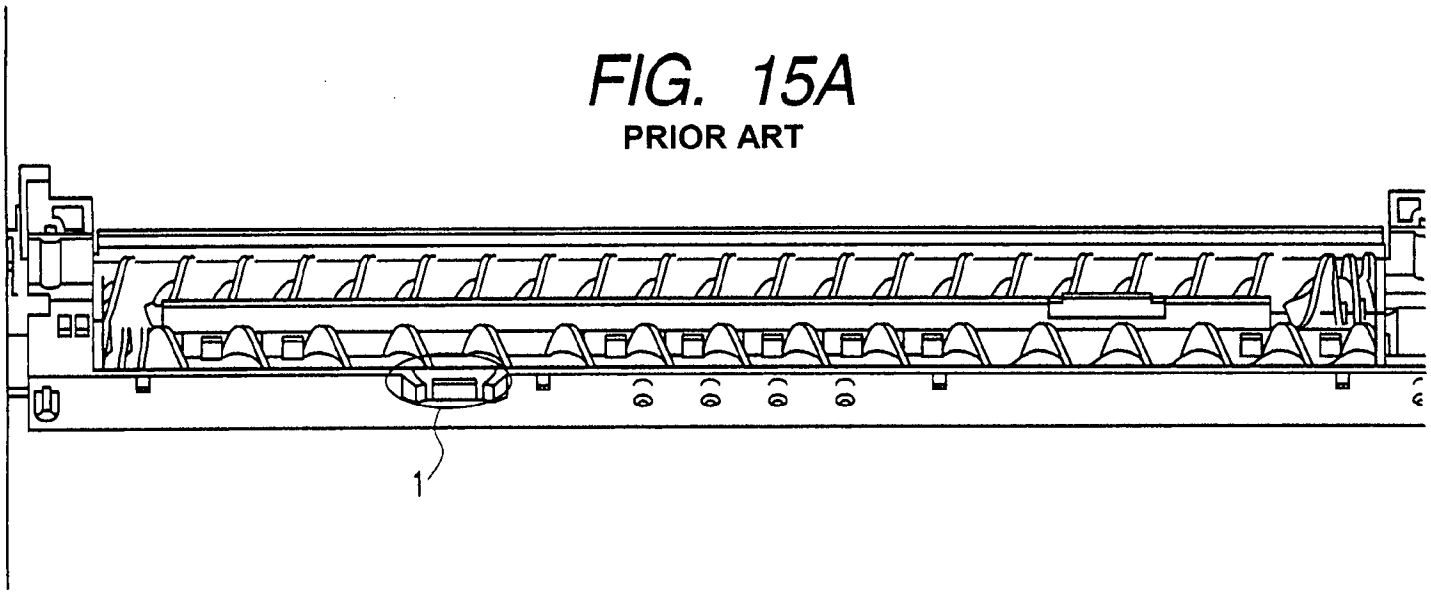
FIG. 15A PRIOR ART
FIGS. 15A and 15B are illustrations showing a conventional embodiment.
Figure 15B:
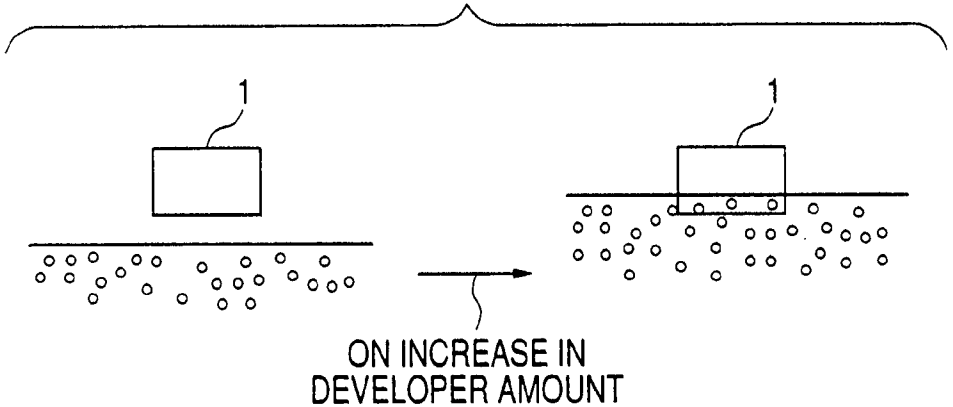
FIG. 15B PRIOR ART

Further, in the present embodiment, as shown in FIGS. 14B, 14C and 14D, there is adopted a construction in which the height of the ceiling of the second agitating chamber R2 is made great near the discharge port 1. By adopting such a construction, it is possible to prevent a great deal of developer from flowing out of the developing apparatus by mistake when the developing apparatus has become inverted with the rotation of the rotational type developing member 101' (rotary).

This is because the upper end edge of the discharge port 1 and the ceiling portion of the second agitating chamber R2 are provided in spaced apart relationship with each other (the space distance X of FIG. 14B) and therefore, the developer having been present below the discharge port 1 when the developing apparatus device is in a state capable of developing (when it is in the posture of FIG. 14A) is contained in an area corresponding to the above-mentioned space distance X when the developing apparatus has become inverted.

Thus, in the present embodiment, the ceiling is not heightened in the entire area of the second agitating chamber R2, but the height of the ceiling is made great only in the area corresponding to the discharge port 1 to thereby achieve the downsizing of the developing apparatus and yet effectively prevent a great deal of developer from flowing out by mistake.

This is also effective in a construction as will be described which has a shutter (value) provided so as to close the discharge port 1 and opened and closed by gravity. It is because even if a value is provided, there is the possibility of not a little developer leaking from the gap of the value. It is particularly effective when the value is not provided.

That is, in the present embodiment, the discharge of the excess developer can be effected with good sensitivity and also, the developer can be prevented from flowing out by mistake with the rotation of the rotational type developing member 101'.

While in the present invention, a developing apparatus having two agitating chambers R1 and R2 is described as an example, the number of the agitating chambers is not restricted to two from the purport of the present invention, but of course, if the developing apparatus is provided with a plurality of developing and agitating chambers, the purport of the present invention will change in no way.

It is preferable that the developer discharge port 1 be provided in any other agitating chamber of the plurality of agitating chambers than the agitating chamber R1 nearest to the location at which the developing sleeve 8 is provided.

As the most characteristic point in the present invention, the operating situation of the excess developer discharging mechanism when the developing screws 7 are rotated will now be described in detail with reference to FIGS. 5A and 5B.

In the present embodiment, design is made such that rotative drive is first inputted from a developing drive input source (not shown) to the sleeve gear (not shown) to the sleeve gear (not shown) of the developing sleeve 8. This rotative drive is designed such that the number of revolutions is adjusted in the interior of the developing apparatus 200Y and the drive is transmitted to the developing screws 7.

FIG. 5A is a front view of essential portions illustrating a state immediately after the developing apparatus 200Y has entered the developing position P1, and FIG. 5B is a front view of essential portions illustrating a state in which the rotative drive has been inputted to the developing apparatus 200Y and the developing sleeve 8 and the developing screws 7 have been rotated.

First, the rotational type developing member 101' in the present embodiment is set so that the developing sleeve 8 may be rotated in the direction indicated by the arrow "a", i.e., so as to get up from a downwardly facing state to a horizontally facing state and therefore, as shown in FIG. 5A, the level of the developer Z contained in the developing apparatus 200Y which has just entered the developing position P1 is higher on the developing sleeve side.

When the rotative drive timing of the developing sleeve 8 soon visits, a controller, not shown, instructs the developing drive input source to rotate, and the rotative drive is transmitted to the developing sleeve gear (not shown). Thereupon, as previously described, the number of revolutions is adjusted in the interior of the developing apparatus 200Y and the developing screws 7*a* and 7*b* receive the transmission of the drive and start to rotate.

The then developer Z, as shown in FIG. 5B, is carried in the direction indicated by the arrow "b" in the interior of the developing apparatus 200Y and is carried to the vicinity of the wall surface 11*b* of the developing container 11.

As previously described, the developing screw 7*b* on the second agitating chamber side is provided with the agitation promoting plate 73, besides the helical auger 72, and therefore, the second developing screw 7*b* is high in agitating and carrying property, as compared with the first developing screw 7*a*. Therefore, the developer Z rotatively carried by the second developing screw 7*b* becomes high in pressure near the wall surface 11*b* and the level thereof becomes high near the wall surface 11*b* because the space in which the developer can be carried by the developing screw 7*b* becomes narrow by the wall surface 11*b* of the developing container 11.

In the embodiment of the present invention, it is the most characteristic point that the stable discharge of the excess developer is realized by the utilization of the movement of the level of the developer accompanying the rotation of the developing screw 7*b*.

By doing so, the height of the level of the developer becomes markedly stable to thereby succeed in obtaining a discharge amount as aimed at, as compared with the afore-described conventional case where the construction of the discharge port is determined on the basis of the height of the level of the developer by revolution, or a case where the construction of the discharge port is determined on the basis of only the height of the level of the developer after the rotation of the developing screws.

Also, in the process of setting the conditions therefore, the number of revolutions of the developing screws which greatly affects changed as in the conventional construction and therefore, as compared with a case where the setting of the conditions depends on only the height and cross-sectional area of the discharge port, the height and area of the agitation promoting plate can be freely changed as the adjustment parameters of the discharge amount and therefore, the setting of the conditions becomes markedly easy to do and a complicated construction is not required and thus, it becomes possible to provide a low-cost and stable excess developer discharging mechanism.

In the embodiment of the present invention, a counter-clockwise direction as viewed from the front of the image forming apparatus has been shown as an example of the direction of rotation of the rotational type developing member 101', but even in the case of clockwise rotation instead of this the inclination of the developer Z when the developing apparatus 200 has entered the developing position P1 only becomes converse and still becomes unstable and therefore, of course, from the purport of the present invention, the direction of rotation of the rotational type developing member 101' is not restricted to one direction.

As described above, because of a construction in which even in a case where the stop positions of the developing apparatus 200Y are not limited to rotation by 120° each, but include other various stop positions such as a nonuniform developer cartridge interchanging position besides the developing position P1, as shown in the example of the conventional art, the excess developer is always discharged only from the developing apparatus 200Y stable in posture when in the developing position P1, and is not discharged from the developing apparatus 200Y when in the other phase positions, there is realized a discharging characteristic which is wide in the copying range and is very stable, and this contributes to the stability of a high quality of image.

As an example of the construction of the rotary developing apparatus 101, the construction of a three-color rotary has been shown in the present embodiment, whereas from the purport of the present invention, the number of the developing apparatuses 200 carried on the rotational type developing member 101' is not restricted thereto, but of course, an effect can be sufficiently obtained even if there is adopted a four-color rotary developing apparatus construction in which the black developing apparatus is disposed in the rotary developing apparatus 101 and design is made so as to effect rotation by 90° each.

Also, even in a case where the rotation stop time of the rotational type developing member 101' is shortened or the rotational type developing member 101' exhibits, besides the developing stop position periodically stably visiting during a continuous image forming operation, unstable stop position behavior such as a home position waiting position visiting after the termination of a job, and a developer cartridge interchange stop waiting position in which the rotational type developing member 101' is stopped and waits only when the toner in the cartridge has become little, or a case where the rotational type developing member 101' has a plurality of stop positions as in a construction wherein the rotational type developing member 101' is stopped and waits at the home position in which the developing sleeve 8 is not opposed to the photosensitive member 113 or a construction in which the rotational type developing member 101' is stopped and waits at a developer cartridge interchanging position, an amount of excess developer aimed at can be reliably discharged, and it has become possible for the discharging mechanism to become stable to thereby maintain a high quality of image.

Also, the excess developer discharging mechanism does not require any complicated constituent member and therefore is of an inexpensive and stable construction, and the work of interchanging the developer becomes unnecessary and thus, an improvement in maintenance property and a reduction in running cost can be realized.

The construction of the multi-color image forming apparatus used in the present embodiment is not restricted to what has been described above, but of course, the present invention is applicable to various multi-color image forming apparatuses.

As has been described above, according to the embodiment of the present invention, a multi-color image forming apparatus using a rotary developing process having a high maintenance property that the interchange of the developers is unnecessary, and high image productivity in continuous single-color image forming can be realized and provided by a single construction.

Figure 6:
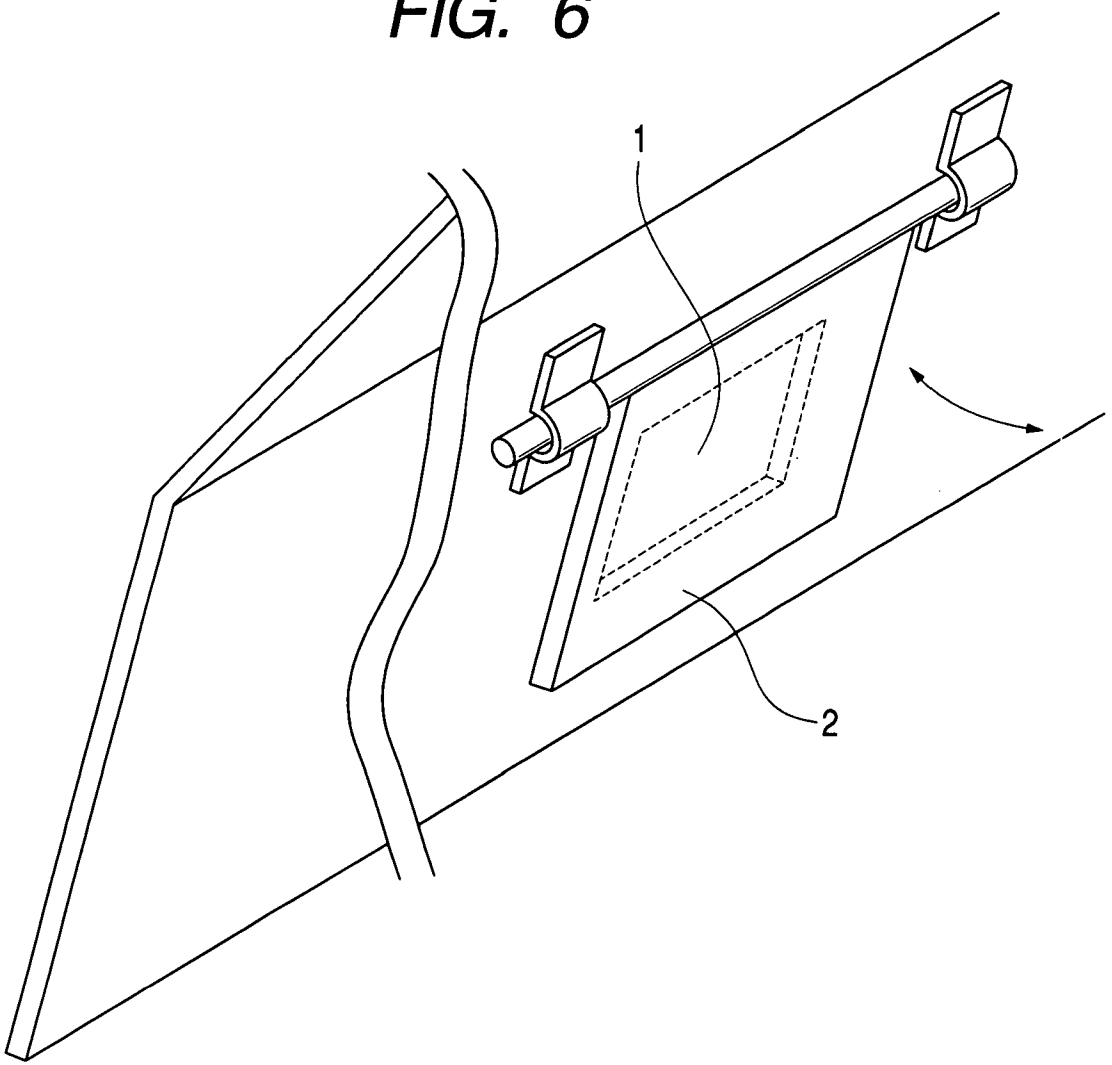
FIG. 6 is a perspective view showing examples of a developer discharge port and a shutter member according to the present invention.
Figure 8:
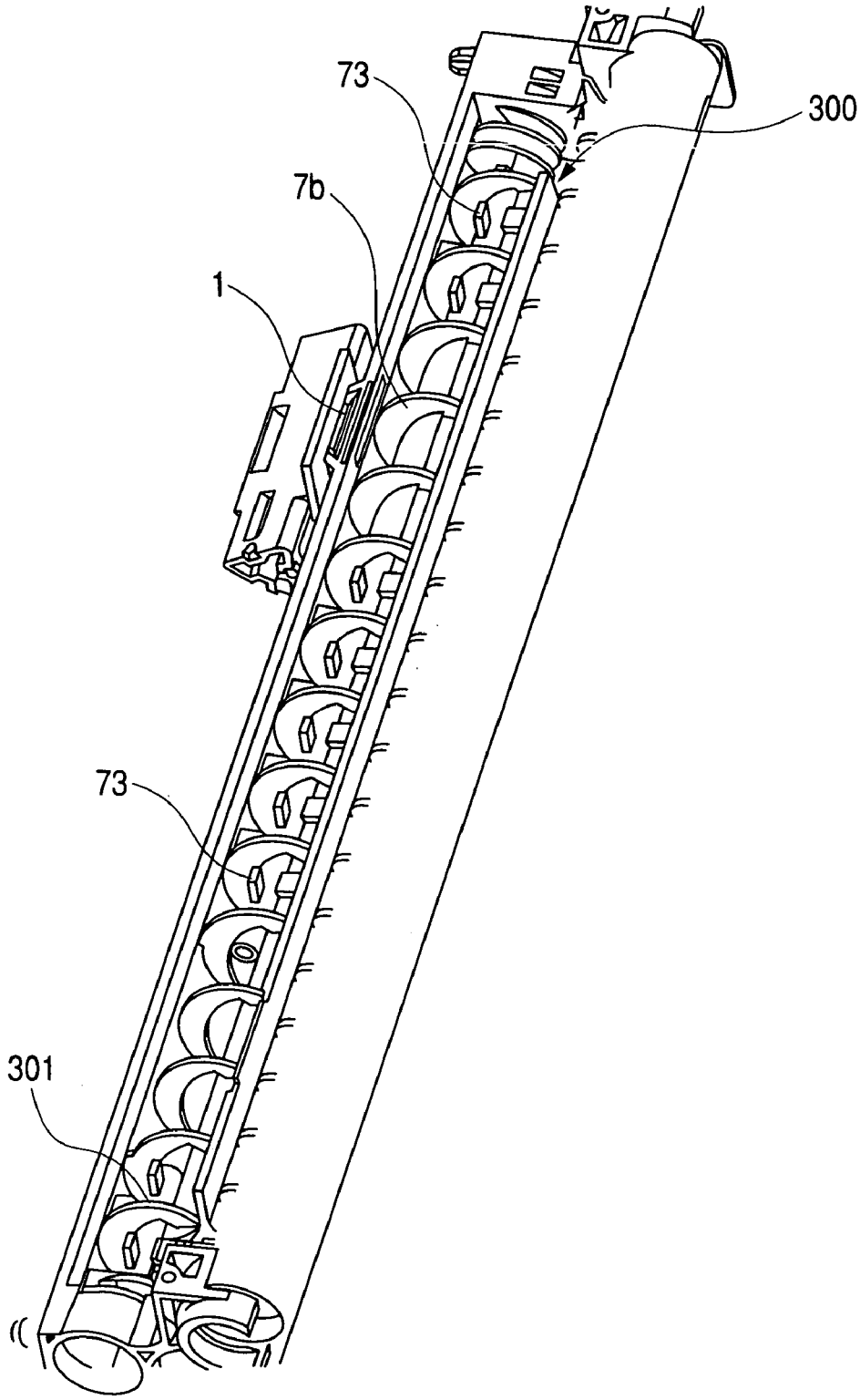
FIG. 8 is a cross-sectional view showing another example of the developing apparatus according to the present invention.
Figure 9B:
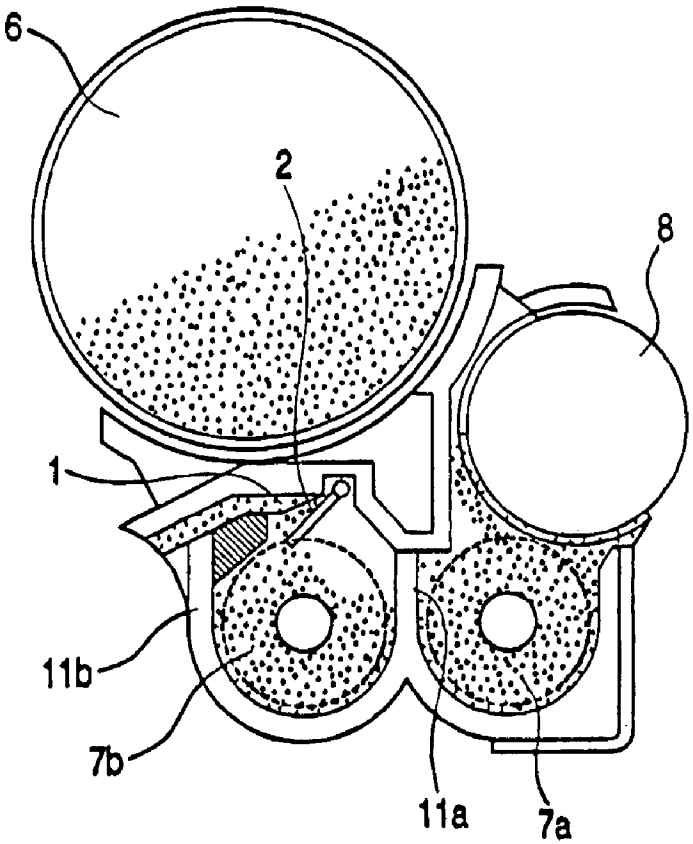
FIGS. 9A and 9B are illustrations showing the behavior of the developer in another example of the developing apparatus according to the present invention.
Figure 9A:
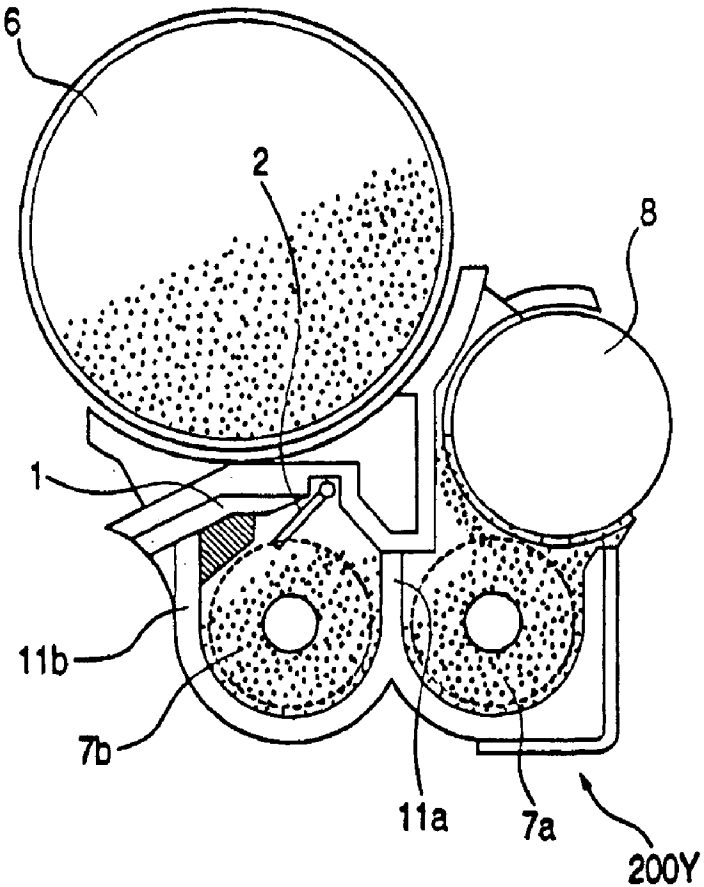
Figure 10:
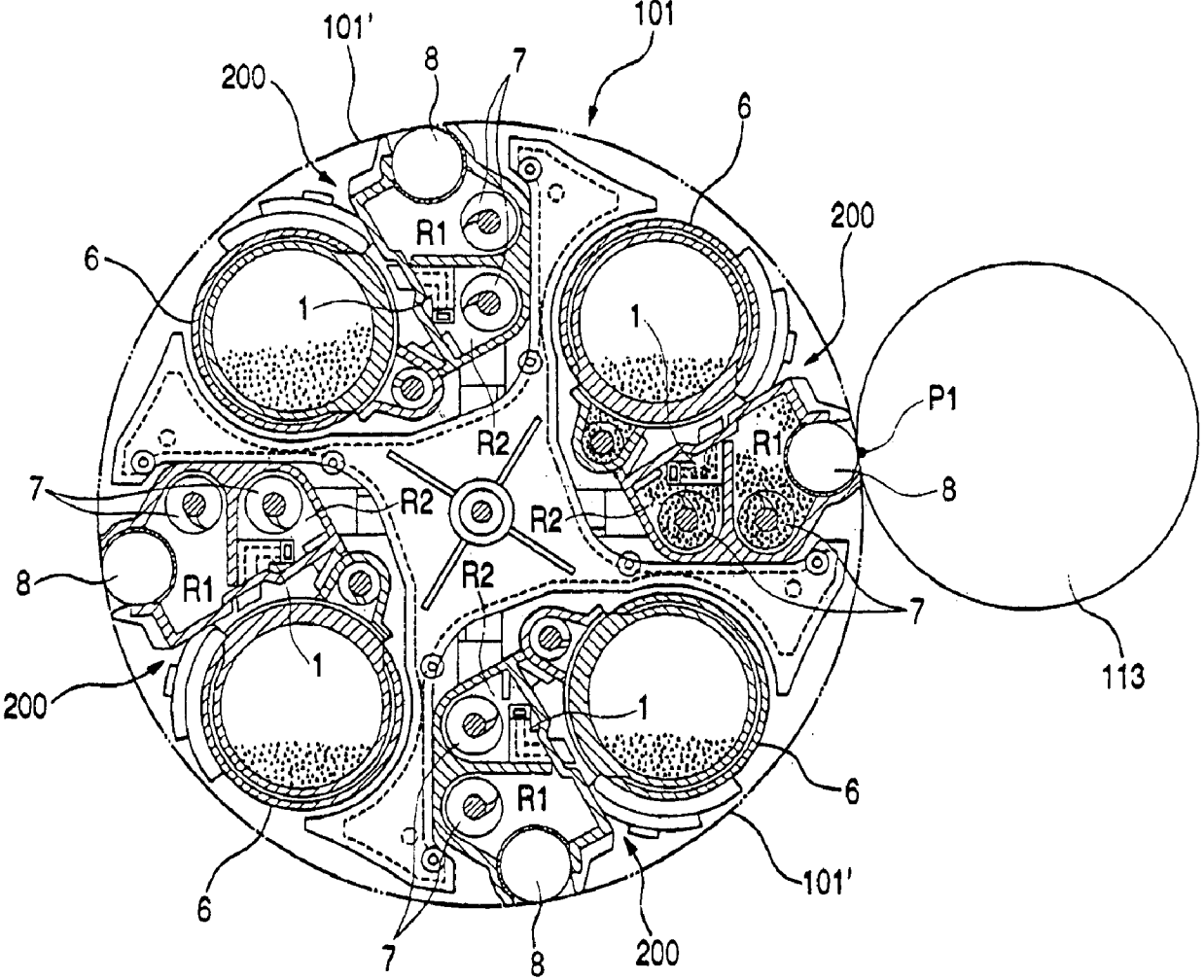
FIG. 10 PRIOR ART
FIG. 10 is a cross-sectional view showing examples of a conventional developing apparatus and rotary member.
Figure 11:
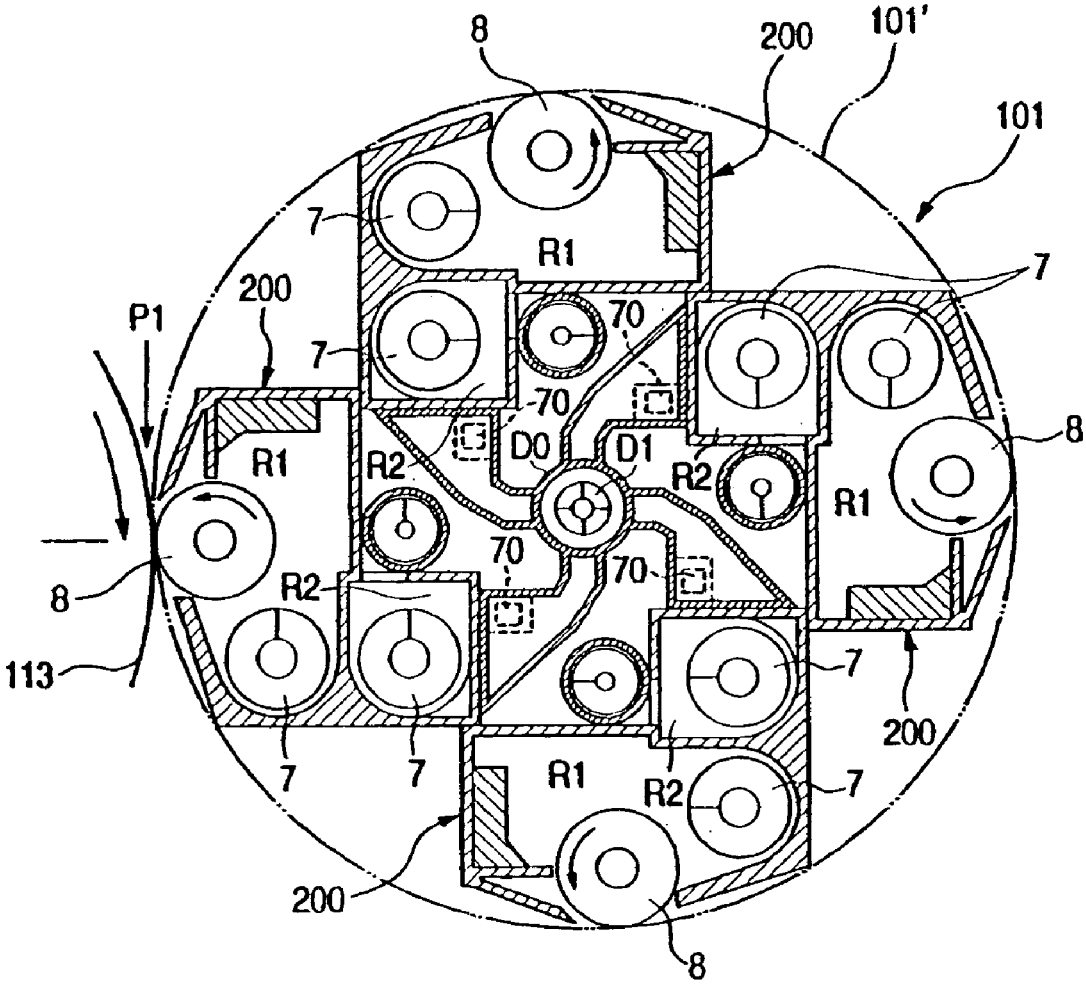
FIG. 11 PRIOR ART
FIG. 11 is a cross-sectional view showing examples of the conventional developing apparatus and rotary member.

The operating situation of the shutter member 2 during an ordinary continuous image forming operation in the developing apparatus 200Y will now be described with reference to FIGS. 6, 7A, 7B and 7C. FIG. 6 is a perspective view of essential portions illustrating the mounted state of the shutter member 2 provided in the discharge port 1 of the developing apparatus 200Y, and FIGS. 7A to 7C are orthoscopic views of essential portions illustrating the operation of the shutter member 2.

First, as shown in FIG. 6, in the developing apparatus 200Y according to the present embodiment, the shutter member 2 is pivotally movably mounted in the excess developer discharge port 1, and the opening-closing angle thereof is prescribed by an opening-closing amount adjusting mechanism (not shown). Thus, the shutter member 2 is controlled to an opened state in the developing position P1, and to a closed state in the other positions, by the gravity thereof.

Next, FIG. 7A shows a state in which in FIG. 2, the developing apparatus 200Y for yellow is in the developing position P1. Here, the positional relation between the developing discharge port 1 and the level of the developer in the developing apparatus 200 is such that the developer discharge port 1 is located above the level of the developer in the developing apparatus 200 and therefore, the shutter member 2 is in its opened state by gravity. As described in the first embodiment, the two-component developer including a toner corresponding to an amount consumed in image forming is supplied from the developer cartridge 6, and when the amount of developer in the developing container 11 is increased and the level of the developer becomes higher than the second developing screw 7*b*, the excess developer overflows the developer discharge port 1 and is discharged, and is collected into a collecting port 4 and therefore, the level of the developer is maintained at the height of the second developer screw 7*b*.

When the developing operation of the developing apparatus 200Y is terminated, the rotational type developing member 101' is rotated by about 120° in preparation for the developing operation by the next developing apparatus 200M, and the developing apparatus 200M is moved to a position P2 in FIG. 2. The then state is shown in FIG. 7B. At this time, the developing sleeve 8 assumes a posture looking upwardly along the periphery of the rotational type developing member 101' and the discharge port 1 comes to underlie the shutter member 2 and therefore, as shown in FIG. 7B, the shutter member 2 is rotatively moved by gravity and the developer discharge port 1 becomes closed and thus, it never happens that the developer in the developing apparatus 200Y leaks out from the developer discharge port 1 to the collecting port 4. The excess two-component developer delivered from the collecting port 4 to the developer collecting pipe 5 is carried by a carrying member 5*a* disposed in the developer collecting pipe 5, and is discharged to the outside of the rotational type developing member 101'.

When the developing operation of the developing apparatus 200M is terminated, the rotational type developing member 101' is again rotated by about 120° in preparation for the developing operation by the developing apparatus 200C for the next color, and the developing apparatus 200Y is moved to a position P3 in FIG. 2. The then state is shown in FIG. 7C. At this time, the developing sleeve 8 assumes a posture looking downwardly along the periphery of the rotational type developing member 101', and the discharge port 1 comes to underlie the shutter member 2 and therefore, as shown, the shutter member 2 still keeps the developer discharge port 1 in its closed state by the pressure of the two-component developer in the developing container 11 and thus, it never happens that the developer in the developing apparatus 200Y leaks out from the developer discharge port 1 to the collecting port 4. Even if the developer should leak out, it will never flow to the developer collecting pipe 5 side by the action in the gravity direction.

As described above, only in the developing position P1, the shutter member 2 becomes opened and it never happens that the excess developer in the developing apparatus 200Y is unexpectedly discharged outwardly and therefore, even when in order to discharge the developer, the plurality of non-uniform rotating operations of the rotational type developing member 101' including the developing position P1 are performed, the amount of developer in the developing apparatus 200Y can be stably maintained within the allowable range and thus, it never happens that a high image quality maintaining characteristic lowers.

By the leakage preventing operation of the excellent shutter member 2 hitherto described, in the embodiment of the present invention, the construction of the storing and discharging path can be made very simple, and this greatly contributes to a reduction of the cost of the rotational type developing member 101', and further of the multi-color image forming apparatuses.

Further, in the present developing apparatus, the following contrivance is made so that the developer can be reliably carried out when it should be discharged.

Figure 12:
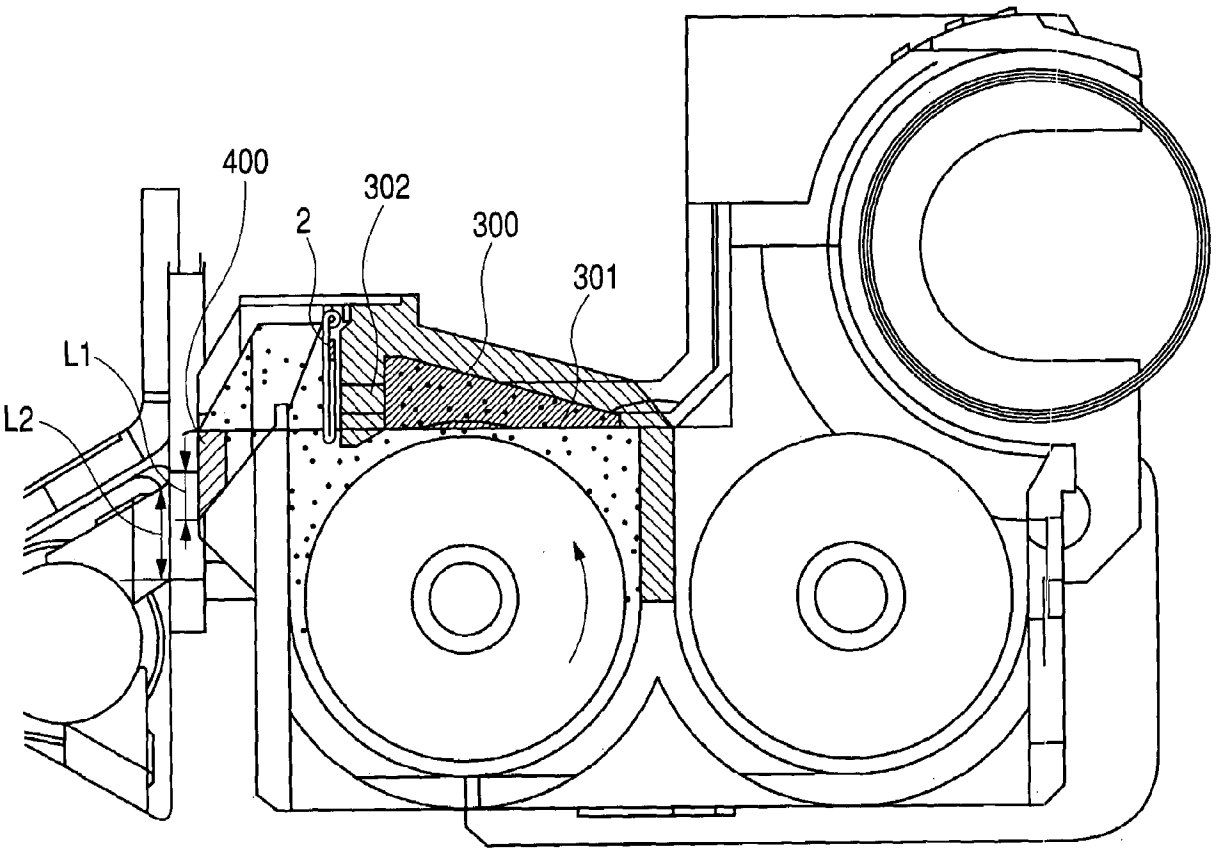
FIG. 12 is a cross-sectional view showing another example of the developing apparatus according to the present invention.

Specifically, in order to make the apparatus sensitive to any change in the level of the developer, as shown in FIG. 12, the wall near the discharge port 1 is made higher as indicated at 300 than at another portion 301 and the cross-sectional area thereof perpendicular to a screw shaft 7 is made large. That is, as shown in FIGS. 14A to 14D, the height of the ceiling of an area in which the discharge port 1 is installed is made greater than the height of the ceilings of areas upstream and downstream of the discharge port 1 with respect to the developer canying direction. The bottom surface of the second agitating chamber R2 is of substantially the same height in the entire area thereof and therefore, the developer compressed on the upstream side of the discharge port 1 suddenly becomes large in cross-sectional area in the area near the discharge port 1, whereby the density of the developer becomes small. Thereupon, the fluidity of the developer heightens. By the fluidity heightening, the developer mildly moves and is discharged without clogging a discharge port 400.

In order to make design such that as shown in FIGS. 14A to 14D, the excess developer is discharged sensitively and properly in conformity with the amount of developer supply, the carrying ability of the carrying member is set as described above so that on the upstream and downstream sides of the discharge port 1 with respect to the developer carrying direction, or at least on the downstream side with respect to the developer carrying direction, the developer may be contained up to the ceiling of the second agitating chamber R2.

Heretofore, the construction has been such that when high-density images are continuously outputted, the density of the developer becomes great and it becomes difficult for the developer to flow. When the developer gets blocked, the movement of the shutter member 2 becomes dull and the old developer remains in the developing container 11 to thereby deteriorate the image. This problem can also be solved by the present construction.

When the developing apparatus 200 is in the developing position P1, the level of the developer near the discharge port 1 becomes stable as quickly as possible and therefore, with the supply of the developer thereafter, the level of the developer fluctuates, whereby a desired amount of developer can be discharged highly accurately.

Also, not only the cross-sectional area is made large, but a wall 302 is provided at a location to which the shutter member 2 is attached, to thereby prevent the inconvenience that by a force the developer receives from the screw shaft, the shutter member 2 is not opened when it should be opened.

Figure 13:
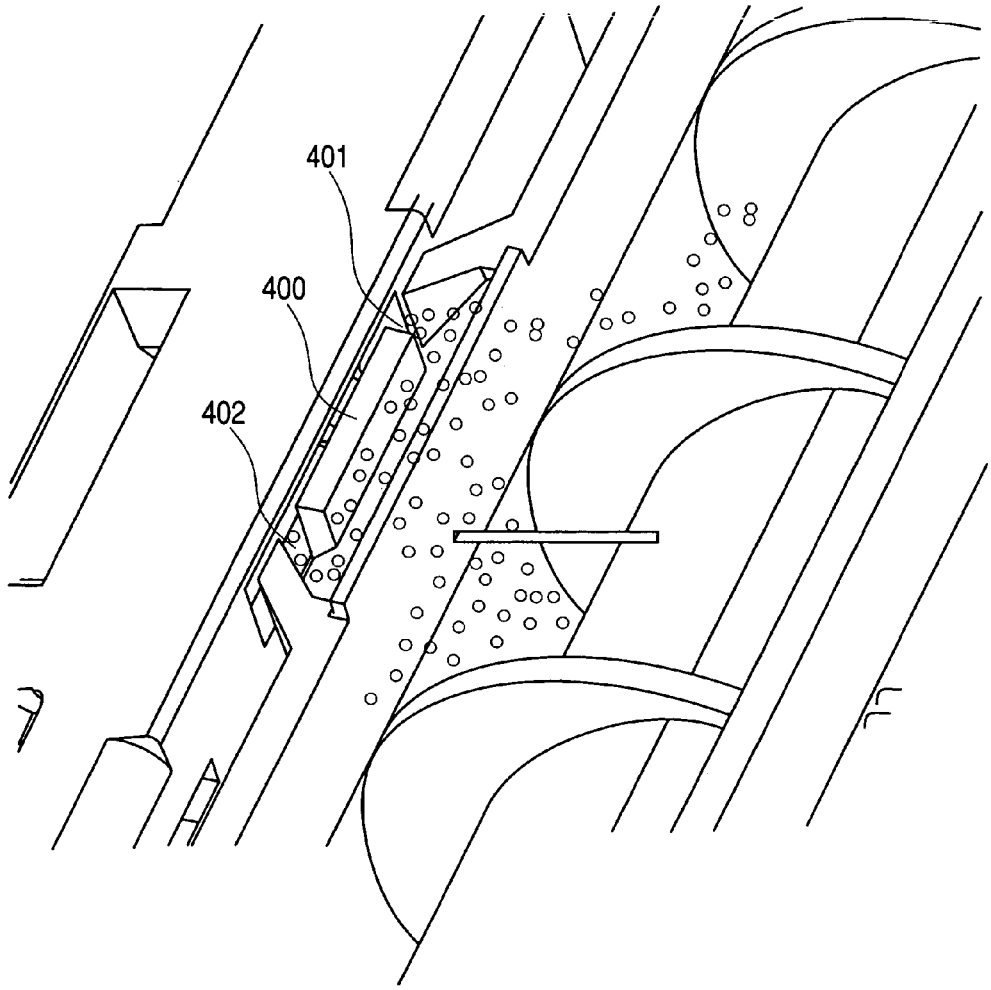
FIG. 13 is an illustration showing another example of the developing apparatus according to the present invention.

Conversely, since the developer is not discharged when it should be discharged, the aforedescribed shutter member 2 is provided, but here is a time lag in opening and closing, and the discharge of the developer cannot completely be intercepted. So, as shown in FIG. 13, an intercepting wall 400 is provided at a toner discharge port downstream of a shutter member to thereby intercept the toner which should not be discharged. Slits 401 and 402 for passing the developer therethrough are provided in both sides of the intercepting wall 400, and the developer passes through the slits 401 and 402 when it should be discharged. The slit shape is not restrictive, but round apertures or the like can also perform the same function as the slits 401 and 402.

Also, it is desirable that the intercepting wall 400 be located at the center of the discharge port.

Further, as shown in FIG. 12, there is adopted a construction in which an opening L2 for awaiting in the main body is made larger than an opening cross section L1 for the developer discharged from the developing container to thereby increase discharging efficiency.

According to the above-described embodiment, the following effects can be obtained.

(A) The agitating member is rotated and the level of the developer near the wall surface of the container downstream of the upper portion of the agitating and carrying member with respect to the direction of rotation thereof rises, whereby for the first time, the excess developer comes to overflow the aforedescribed excess developer discharge port and therefore, even under a situation in which the rotating speed of the agitating member becomes great and the state of the level of the developer is liable to become unstable, the excess developer discharging ability has become stable and the more reliable stability of a high quality of image has come to be obtained. Further, an intercepting portion is provided below the discharge port to thereby stabilize the flow of the developer, whereby a sufficient effect has been obtained.

(B) Also, even when the developing apparatus is mounted on the rotary member and the rotary member exhibits unstable stop position behavior and even when it has a plurality of stop positions, a desired amount of excess developer can be reliably discharged, and it has become possible for the discharging mechanism to stably maintain a high quality of image.

(C) Also, when provision is made of a plate-shaped agitation promoting member for promoting an agitating property by an agitating member, it has become possible to suitably apply the characteristic thereof, and easily adjustable parameters increase, whereby the shortening of the development period and a reduction in cost could be realized.

(D) Since it is possible to stably maintain the amount of developer in the developing apparatus within an allowable value, a high image quality maintaining characteristic has come not to lower. In addition, when mechanism members for once storing the excess developer therein are required, the complication and bulkiness of these mechanism members and the apparatus can be prevented and therefore, the complication and higher cost of the multi-color image forming apparatus itself are not caused, and the interchange of the developers during service maintenance has become unnecessary and thus, the maintenance property has been improved and the high image quality maintaining property could be secured.

As described above, according to the above-described embodiments, it is possible to achieve downsizing and yet effectively prevent the developer from flowing out by mistake with the rotation of the rotary member.

Further, it is possible to effect the discharge of the excess developer with good sensitivity, and it is possible to prevent a faulty image attributable to the developer being not properly discharged.

Accordingly, in lengthening the life of the developer, it becomes possible to stably and highly accurately carry out the process of discharging the developer from the discharge port by the utilization of a fluctuation in the level of the developer, without making the developing device, and particularly the second chamber, large in size.

What is claimed is:

1. A developing apparatus comprising:

a plurality of developing containers, each containing developer including toner and a carrier, each of said plurality of developing containers having a first chamber provided with a developer carrying member for carrying the developer to develop an electrostatic image formed on an image bearing member, and a second chamber constituting a circulation route for the developer between said first chamber and said second chamber;

a carrying member for carrying the developer in said second chamber;

an opening portion provided in a side of said second chamber for permitting the overflow of an excess developer with a supply of the developer; and a rotary member rotatable with said plurality of developing containers held thereon, said rotary member being adapted to selectively position a desired developing container at a developing position, wherein in a state in which the desired developing container is positioned at the developing position, a height of a ceiling of said second chamber near said opening portion is greater than a height of the ceiling of said second chamber on an upstream side and a downstream side of said opening portion with respect to a developer carrying direction.

2. A developing apparatus according to claim 1, wherein a developer carrying ability of said carrying member near said opening portion is greater than a developer carrying ability on a downstream side of said opening portion with respect to a developer carrying direction.

3. A developing apparatus according to claim 2, wherein a height of a bottom surface of said second chamber near said opening portion is substantially equal to a height of the bottom surface of said second chamber on the downstream side of said opening portion with respect to the developer carrying direction.

4. A developing apparatus according to claim 1, wherein a developer carrying ability of said carrying member near said opening portion is greater than a developer carrying ability of said carrying member on the upstream side and the downstream side of said opening portion with respect to the developer carrying direction.

5. A developing apparatus according to claim 4, wherein a height of a bottom surface of said second chamber near said opening portion is substantially equal to a height of the bottom surface of said second chamber on the upstream side and the downstream side of said opening portion with respect to the developer carrying direction.

* * * * *

UNITED STATES PATENT AND TRADEMARK OFFICE

CERTIFICATE OF CORRECTION

PATENT NO. : 7,110,702 B2
APPLICATION NO. : 10/832380
DATED : September 19, 2006
INVENTOR(S) : Toshiro Tomono et al.

It is certified that error appears in the above-identified patent and that said Letters Patent is hereby corrected as shown below:

ON THE TITLE PAGE, AT ITEM (57), Abstract:
Line 3, “deal” should read --quantity--.

COLUMN 4:
Line 54, “other rotation modes” should read --rotation modes other--.

COLUMN 5:
Line 9, “being not” should read --not being--.

COLUMN 6:
Delete lines 37 to 56.
Line 66, “amd” should read --and--.

COLUMN 9:
Line 66, “had” should read --made--.

COLUMN 11:
Line 30, “maimer” should read --manner--.

COLUMN 12:
Line 61, “developer” should read --developing--.

COLUMN 13:
Line 14, “circulating” should read --developing--.
Line 39, “chamber P2,” should read --chamber R2,--.

COLUMN 14:
Line 8, “path” should read --port--.
Line 36, “increase” should read --increased--.
Line 43, “that” should read --such that--.

COLUMN 15:
Line 2, “across” should read --cross--.

COLUMN 16:
Line 8, “to the” (second occurrence) should be deleted.
Line 9, “sleeve gear (not shown)” should be deleted.

COLUMN 17:
Line 3, “affects changed” should read --affects image characteristics cannot be significantly changed--.

UNITED STATES PATENT AND TRADEMARK OFFICE

CERTIFICATE OF CORRECTION

PATENT NO. : 7,110,702 B2
APPLICATION NO. : 10/832380
DATED : September 19, 2006
INVENTOR(S) : Toshiro Tomono et al.

It is certified that error appears in the above-identified patent and that said Letters Patent is hereby corrected as shown below:

COLUMN 18:
Line 57, "developer" should read --developing--.
Line 63, "then" should read --resulting--.

COLUMN 19:
Line 16, "then" should read --resulting--.
Line 39, "lowers." should read --decreases.--.
Line 55, "shaft 7" should read --shaft--.
Line 60, "canying" should read --carrying--.

COLUMN 21:
Line 21, "come not to lower." should read --not become lower--.

Signed and Sealed this

Fifteenth Day of May, 2007

JON W. DUDAS
*Director of the United States Patent and Trademark Office*